US011602930B2

(12) United States Patent
Yamashita

(10) Patent No.: US 11,602,930 B2
(45) Date of Patent: Mar. 14, 2023

(54) INKJET RECORDING APPARATUS

(71) Applicant: KYOCERA Document Solutions Inc., Osaka (JP)

(72) Inventor: Keisuke Yamashita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 91 days.

(21) Appl. No.: 17/220,168

(22) Filed: Apr. 1, 2021

(65) Prior Publication Data

US 2021/0309009 A1 Oct. 7, 2021

(30) Foreign Application Priority Data

Apr. 7, 2020 (JP) ..... JP2020-069237

(51) Int. Cl.
*B41J 2/045* (2006.01)
*B41J 2/14* (2006.01)
*B41J 2/165* (2006.01)

(52) U.S. Cl.
CPC ..... *B41J 2/0451* (2013.01); *B41J 2/14* (2013.01); *B41J 2002/16514* (2013.01)

(58) Field of Classification Search
CPC .. B41J 11/0095; B41J 11/003; B41J 13/0009; B41J 2/0451; B41J 2/14; B41J 2/145; B41J 11/007; B41J 2002/16514; B41J 29/38
See application file for complete search history.

(56) References Cited

U.S. PATENT DOCUMENTS 8,382,241 B2 * 2/2013 Saitoh ..... B41J 2/16526 347/35

FOREIGN PATENT DOCUMENTS

JP 2011-213095 10/2011

* cited by examiner

*Primary Examiner* — Jannelle M Lebron
(74) *Attorney, Agent, or Firm* — Lex IP Meister, PLLC

(57) ABSTRACT

The controller of an inkjet recording apparatus supplies a recording medium onto the conveyor belt with a pair of registration rollers based on a detection result of the trailing edge of the recording medium by a first detection sensor and a detection result of an opening by a second detection sensor. The controller determines whether the recording medium is being placed on the conveyor belt coinciding with the opening that is moved due to the traveling of the conveyor belt, and based on the determination result, the controller controls the recording head to execute flushing and the pair of registration rollers to supply a subsequent recording medium onto the conveyor belt.

11 Claims, 13 Drawing Sheets

(WHEN D ≤ C – A)

(WHEN D > C – A)

(WHEN E < C – B)

(WHEN E ≥ C – B)

(WHEN A < C < B)

(WHEN D ≤ C – A)

(WHEN D > C – A)

INKJET RECORDING APPARATUS

INCORPORATION BY REFERENCE

This application is based upon, and claims the benefit of priority from corresponding Japanese Patent Application No. 2020-069237 filed in the Japan Patent Office on Apr. 7, 2020, the entire contents of which are incorporated herein by reference.

BACKGROUND

Field of the Invention

The present disclosure relates to an inkjet recording apparatus that ejects ink onto a recording medium and records an image.

Description of Related Art

Conventionally, in an inkjet recording apparatus such as an inkjet printer, flushing (empty ejection) is performed by periodically ejecting ink from the nozzle in order to reduce or prevent clogging of the nozzle due to drying of the ink. Typically, an opening is provided in the conveyor belt that conveys the recording medium and when the opening comes to a position facing the recording head due to the traveling of the conveyor belt, ink is ejected from the nozzle of the recording head to clear the opening.

SUMMARY

The inkjet recording apparatus according to one aspect of the present disclosure includes a recording head, a pair of registration rollers, an endless conveyor belt, first and second detection sensors, and a controller that controls the recording head and the pair of registration rollers. The recording head has a plurality of nozzles that eject ink. The endless conveyor belt conveys a recording medium to a position facing the recording head, and has a plurality of openings in a conveyance direction of the recording medium, through which the ink passes when in positions facing the recording head when the recording head executes flushing by ejecting ink at a time different from the time that contributes to image formation on the recording medium. The pair of registration rollers supply the recording medium onto the conveyor belt. The first detection sensor detects a recording medium, by being positioned on an upstream side of the pair of registration rollers in a supply direction of the recording medium, and the second detection sensor detects a position of an opening of the conveyor belt. The controller determines whether the recording medium supplied onto the conveyor belt by the pair of registration rollers is placed on the conveyor belt coinciding with the opening that is moved due to the traveling of the conveyor belt based on a detection result of the trailing edge of the recording medium by the first detection sensor and a detection result of the opening by the second detection sensor and controls the execution of flushing by the recording head and controls supply of a subsequent recording medium by the pair of registration rollers onto the conveyor belt based on the determination.

DETAILED DESCRIPTION

1. Configuration of Inkjet Recording Apparatus

Figure 1:
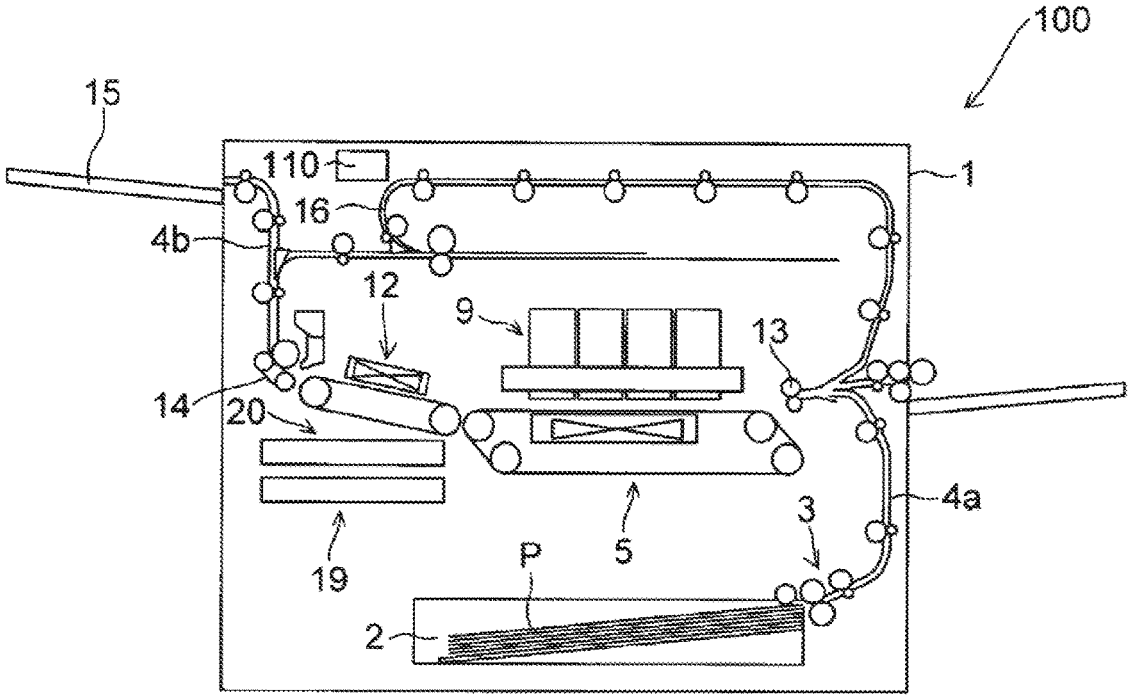
FIG. 1 is an explanatory diagram schematically illustrating a configuration of a printer as an inkjet recording apparatus according to an embodiment of the present disclosure.

Hereinafter, embodiments of the present disclosure will be described with reference to the accompanying drawings. FIG. 1 is an explanatory diagram illustrating a schematic configuration of a printer 100 as an inkjet recording apparatus according to an embodiment of the present disclosure. The printer 100 includes a paper feed cassette 2 which is a paper storage unit. The paper feed cassette 2 is arranged in the lower inside portion of the printer main body 1. Paper P, which is an example of a recording medium, is stored inside the paper feed cassette 2.

The paper feeder 3 is arranged on the downstream side of the paper feed cassette 2 in the paper conveyance direction, that is, above the right side of the paper feed cassette 2 in FIG. 1. The paper feeder 3, separates and sends out the paper P sheet by sheet toward the upper right side of the paper feed cassette 2 in FIG. 1.

The printer 100 includes a first paper conveyance path 4*a* inside the printer 100. The first paper conveyance path 4*a* is positioned on the upper right side of the paper feed cassette 2 in the paper feed direction. The paper P sent out from the paper feed cassette 2 is conveyed vertically upward along the side surface of the printer main body 1 by the first paper conveyance path 4*a*.

A pair of registration rollers 13 are provided at the downstream end of the first paper conveyance path 4*a* in the paper conveyance direction. Further, the first conveyance unit 5 and the recording unit 9 are arranged in the immediate vicinity of the pair of registration rollers 13 on the downstream side in the paper conveyance direction. The paper P sent out from the paper feed cassette 2 reaches the pair of registration rollers 13 through the first paper conveyance path 4*a*. The pair of registration rollers 13 correct tilt of the paper P during sending, measure the timing of the ink ejection operation executed by the recording unit 9, and send the paper P toward the first conveyance unit 5.

The paper P sent to the first conveyance unit 5 is conveyed by the first conveyor belt 8 to a position facing the recording unit 9 (particularly, the recording heads 17*a* to 17*c* described later). An image is recorded on the paper P by ink ejected from the recording unit 9 onto the paper P. At this time, the ink ejection in the recording unit 9 is controlled by the controller 110 inside the printer 100. The controller 110 is composed of, for example, a central processing unit (CPU), and has functions including a calculator to perform necessary calculations and a clock that measures time.

In the paper conveyance direction, the second conveyance unit 12 is arranged on the downstream side (left side in FIG. 1) of the first conveyance unit 5. The paper P, on which the image is recorded by the recording unit 9 is sent to the second conveyance unit 12. The ink ejected onto the surface of the paper P dries while passing through the second conveyance unit 12.

In the paper conveyance direction, a decurling section 14 is provided on the downstream side of the second conveyance unit 12 and near the left side surface of the printer main body 1. The paper P whose ink has been dried by the second conveyance unit 12 is sent to the decurling section 14, and the curl that has occurred on the paper P is corrected.

A second paper conveyance path 4*b* is provided on the downstream side (upward in FIG. 1) of the decurling section 14 in the paper conveyance direction. When double-sided recording is not performed, the paper P that has passed through the decurling section 14 passes through the second paper conveyance path 4*b* and is discharged to the paper discharge tray 15 provided on the outer left side surface of the printer 100.

A reverse conveyance path 16 for double-sided recording is provided above the recording unit 9 and the second conveyance unit 12 in the upper part of the printer main body 1. When double-sided recording is performed, after the recording on one side (the first side) of the paper P is completed, the paper P that has passed through the second conveyance unit 12 and the decurling section 14 passes through the second paper conveyance path 4*b* and is sent to the reverse conveyance path 16.

The conveyance direction of the paper P sent to the reverse conveyance path 16 is subsequently turned over for recording on the other side (the second side) of the paper P. Then, the paper P passes through the upper part of the printer main body 1 and is sent toward the right side, and is sent to the first conveyance unit 5 again through the pair of registration rollers 13 in a state where the second side is facing upward. In the first conveyance unit 5, the paper P is conveyed to a position facing the recording unit 9, and an image is recorded on the second surface by ink ejected from the recording unit 9. After double-sided recording, the paper P is discharged to the paper discharge tray 15 by going through the second conveyance unit 12, the decurling section 14, and the second paper conveyance path 4*b* in order.

A maintenance unit 19 and a cap unit 20 are arranged below the second conveyance unit 12. The maintenance unit 19 moves horizontally below the recording unit 9 when purging is executed, wipes the ink pushed out from the ink ejection port of the recording head, and collects the wiped ink. Purging refers to an operation of forcibly pushing out ink from the ink ejection port of the recording head in order to discharge thickened ink, foreign matter, and air bubbles from the ink ejection port. When capping the ink ejection surface of the recording head, the cap unit 20 moves horizontally below the recording unit 9, then moves upward to mount to the lower surface of the recording head.

Figure 2:
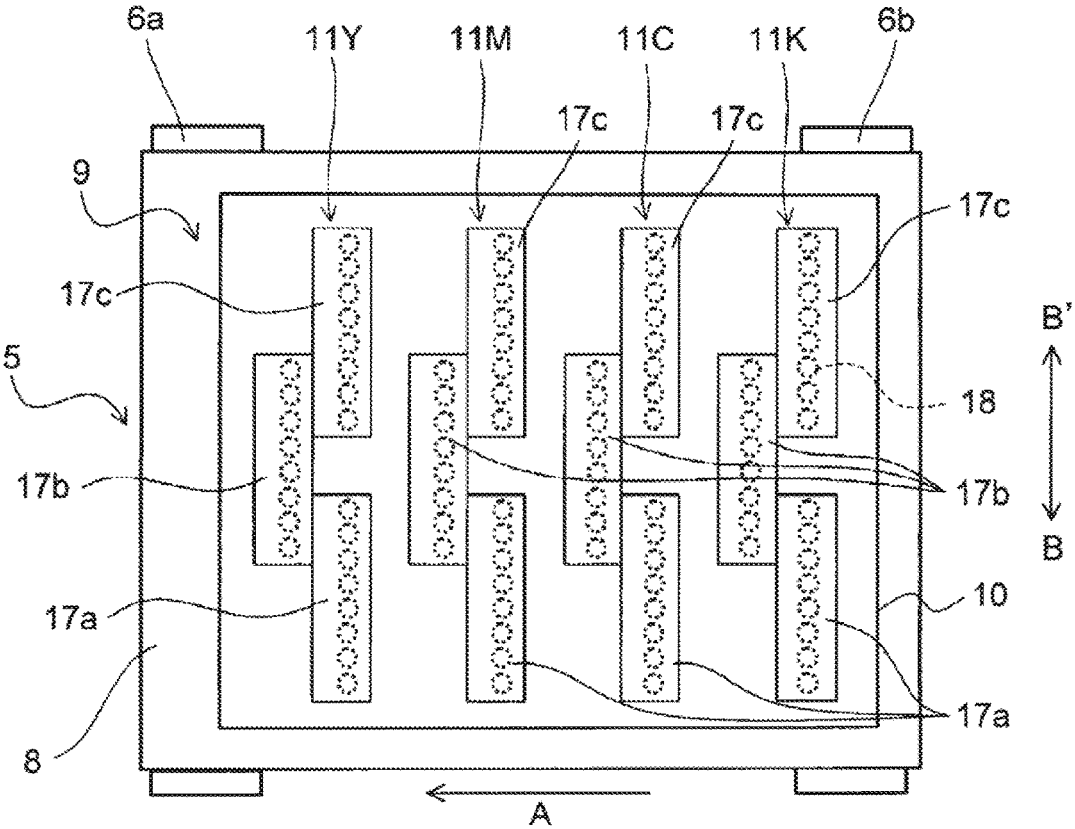
FIG. 2 is a plan view of a recording unit included in the printer.

FIG. 2 is a plan view of the recording unit 9. The recording unit 9 includes a head housing 10 and line heads 11Y, 11M, 11C, and 11K. The line heads 11Y to 11K are held in the head housing 10 and are formed to have a specific interval of height (for example, 1 mm) with respect to the conveyance surface of the endless first conveyor belt 8 stretched on a plurality of rollers including the drive roller 6*a*, the driven roller 6*b*, and the other rollers 7*a* and 7*b*. The driving of the drive roller 6*a* is controlled by the controller 110.

The line heads 11Y to 11K each have a plurality of (three in this example) recording heads 17*a* to 17*c*. The recording heads 17*a* to 17*c* are arranged in a staggered manner along the paper width direction (the direction of arrow BB'), which is orthogonal to the paper conveyance direction (the direction of arrow A). The recording heads 17*a* to 17*c* have a plurality of ink ejection ports 18 (nozzles). The ink ejection ports 18 are arranged side by side at equal intervals in the width direction of the recording head, that is, in the paper width direction (the direction of arrow BB'). The line heads 11Y to 11K eject inks of each color of yellow (Y), magenta (M), cyan (C), and black (K) through the ink ejection ports 18 of the recording heads 17*a* to 17*c* and toward the paper P conveyed by the first conveyor belt 8.

Figure 3:
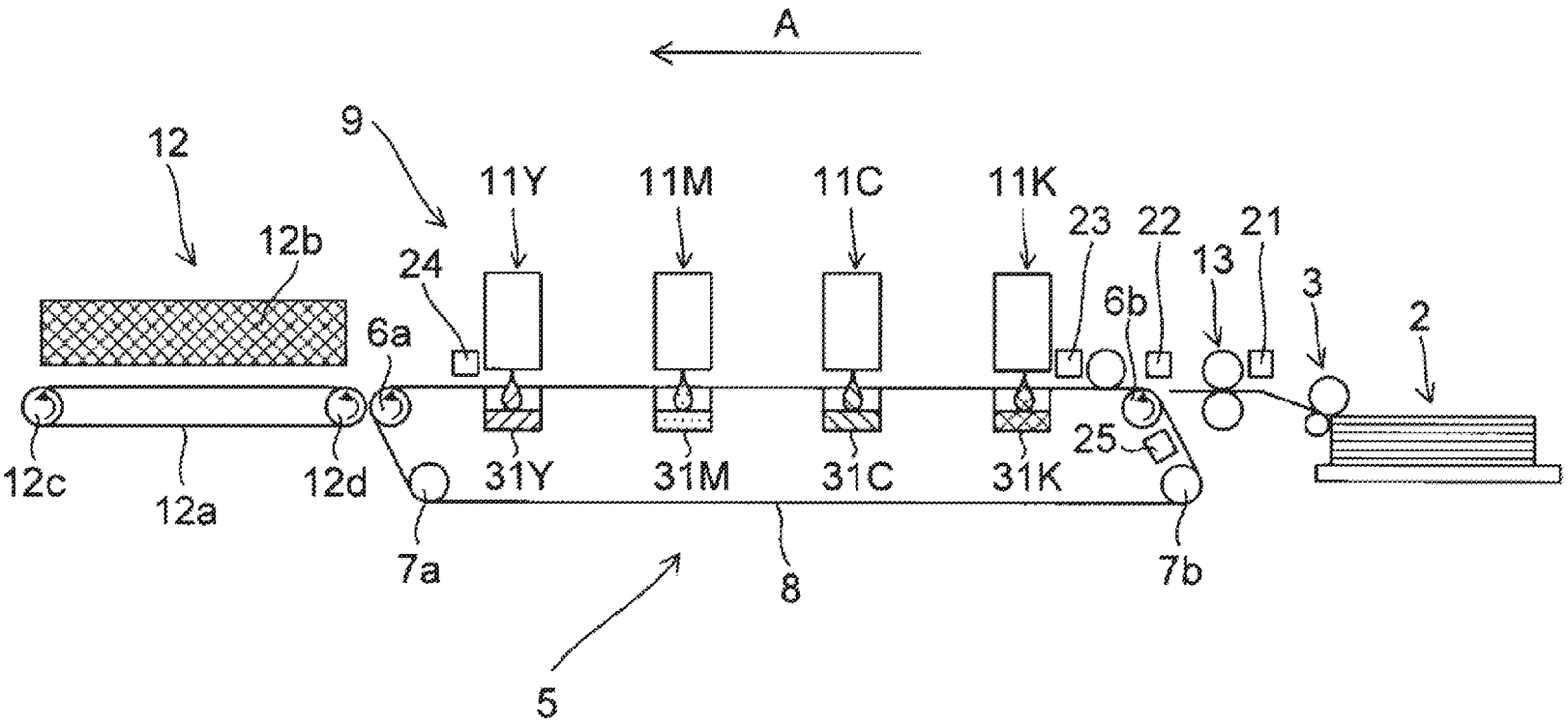
FIG. 3 is an explanatory diagram schematically illustrating a configuration around a paper conveyance path from a paper feed cassette of the printer to a second conveyance unit via a first conveyance unit.
Figure 4:
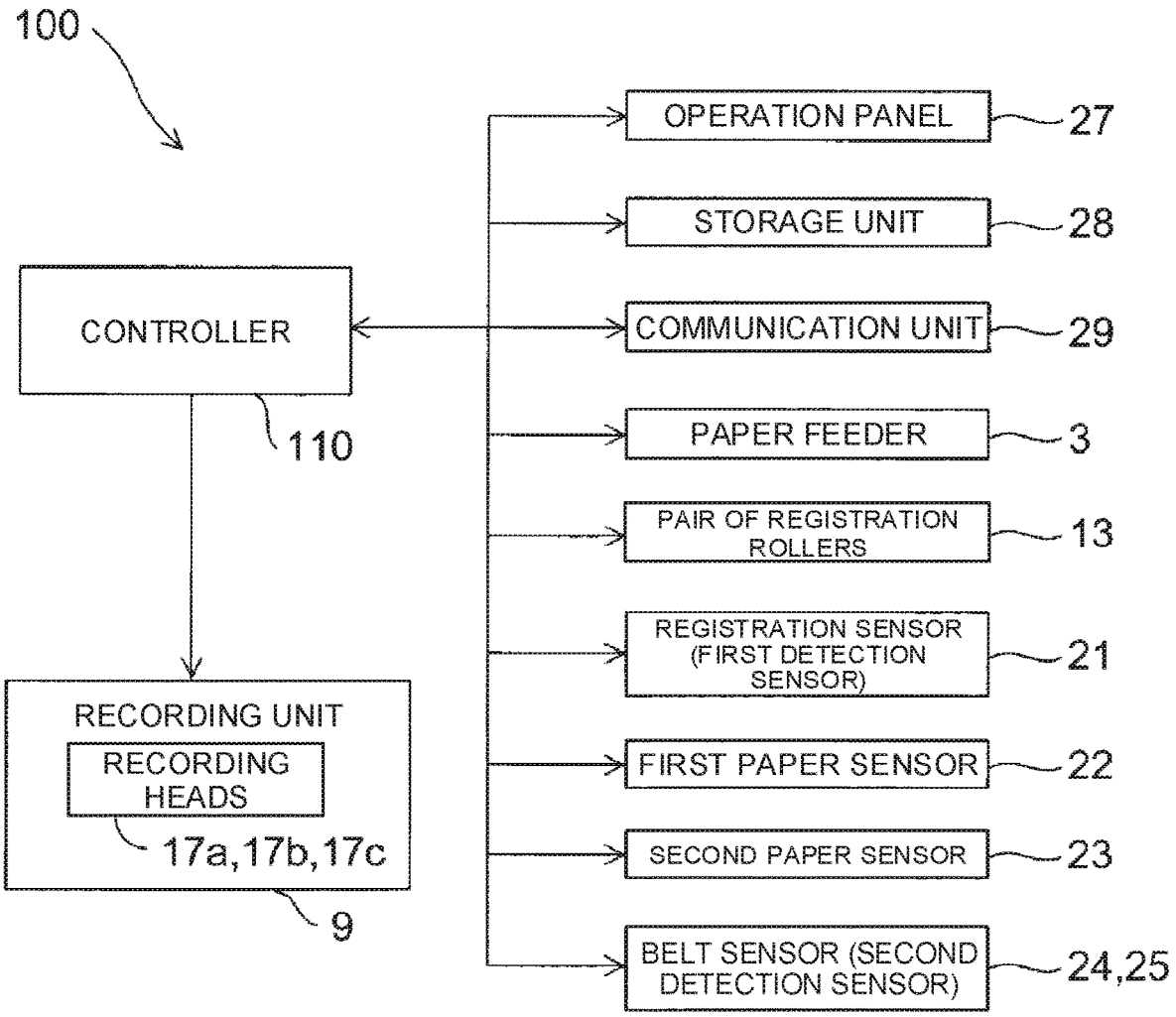
FIG. 4 is a block diagram illustrating the hardware configuration of the main part of the printer.

FIG. 3 schematically illustrates the configuration around the conveyance path of the paper P from the paper feed cassette 2 to the second conveyance unit 12 via the first conveyance unit 5. Further, FIG. 4 is a block diagram illustrating a hardware configuration of a main part of the printer 100. In addition to the above configuration, the printer 100 further includes a registration sensor 21, a first paper sensor 22, a second paper sensor 23, and belt sensors 24 and 25.

The registration sensor 21 detects the paper P that is conveyed from the paper feed cassette 2 by the paper feeder 3 and sent to the pair of registration rollers 13. The registration sensor 21 is a first detection sensor that detects the paper P at a position on the upstream side of the pair of registration rollers 13 in the supply direction of the paper P. The controller 110 can control the rotational start time of the pair of registration rollers 13 based on the detection result of the registration sensor 21. For example, based on the detection result of the registration sensor 21, the controller 110 can control the supply time of the paper P to the first conveyor belt 8 after skew (tilt) correction by the pair of registration rollers 13.

The first paper sensor 22 is a sensor that detects the position in the width direction of the paper P sent from the pair of registration rollers 13 to the first conveyor belt 8. Based on the detection result of the first paper sensor 22, from among the ink ejection ports 18 corresponding to the recording heads 17*a* to 17*c* of the line heads 11Y to 11K, the controller 110 can cause ink to be ejected from the ink ejection ports 18 in the width of the paper P thereby an image can be recorded on the paper P.

The second paper sensor 23 is a sensor that detects the passage of the paper P supplied to the first conveyor belt 8 by the pair of registration rollers 13. That is, the second paper sensor 23 detects the position of the paper P conveyed by the first conveyor belt 8 in the conveyance direction. The second paper sensor 23 is positioned on the upstream side of the recording unit 9 and on the downstream side of the first paper sensor 22 in the paper conveyance direction. Based on the detection result of the second paper sensor 23, the controller 110 controls the ink ejection timing with respect to the paper P reaching a position facing the line heads 11Y to 11K (recording heads 17*a* to 17*c*) by the first conveyor belt 8.

The belt sensors 24 and 25 are second detection sensors provided on the first conveyor belt 8 to detect the positions of a plurality of opening groups 82 or openings 80 (see FIG. 5), which will be described later. That is, the belt sensors 24 and 25 detect the passage of at least one of the opening groups 82 due to the traveling of the first conveyor belt 8. The belt sensor 24 is positioned on the downstream side of the recording unit 9 in the paper conveyance direction (traveling direction of the first conveyor belt 8). The belt sensor 25 is positioned on the upstream side in the paper conveyance direction with respect to the driven roller 6*b* on which the first conveyor belt 8 is stretched. Therefore, the belt sensor 25 may be positioned between the driven roller 6*b* and the other roller 7*b*, or may be positioned between the roller 7*a* and the roller 7*b*. The driven roller 6*b* is positioned on the upstream side in the traveling direction of the first conveyor belt 8 with respect to the recording unit 9. The belt sensor 24 also has the same function as the second paper sensor 23. Based on the detection result of the belt sensors 24 or 25, the controller 110 can control the pair of registration rollers 13 so as to supply the paper P to the first conveyor belt 8 at a specific time.

Further, the position of the paper is detected by a plurality of sensors (second paper sensor 23, belt sensor 24), and the position of the opening group 82 of the first conveyor belt 8 is detected by the plurality of sensors (belt sensors 24 and 25), so that it is possible to correct the error of the detected position and detect an abnormality.

The first paper sensor 22, the second paper sensor 23, and the belt sensors 24 and 25 described above may be configured as transmissive or reflective optical sensors, or contact image sensors (CIS sensors). Further, a mark corresponding to the position of the opening group 82 may be formed at an end of the first conveyor belt 8 in the width direction, and the belt sensors 24 and 25 may detect the position of the opening group 82 by detecting this mark.

In addition, the printer 100 may be provided with a meandering detection sensor that detects meandering of the first conveyor belt 8, and may be configured to correct the meandering of the first conveyor belt 8 based on the detection result.

The printer 100 further includes an operation panel 27, a storage unit 28, and a communication unit 29.

The operation panel 27 is an operation unit for receiving various setting inputs by the user. For example, the user can operate the operation panel 27 to input information on the size the size of the paper P to be set in the paper feed cassette 2, that is, the size of the paper P to be conveyed by the first conveyor belt 8.

The storage unit 28 is a memory device that stores the operation program of the controller 110 along with various information, and is configured by including read only memory (ROM), random access memory, (RAM), a non-volatile memory, and the like. The information set by the operation panel 27 (for example, the size information of the paper P) is stored in the storage unit 28.

The communication unit 29 is a communication interface for transmitting and receiving information to and from an external device (for example, a personal computer (PC)). For example, when a user operates a PC and sends a print command together with image data to the printer 100, the image data and the print command are input to the printer 100 via the communication unit 29. In the printer 100, the controller 110 controls the recording heads 17*a* to 17*c* based on the image data to eject ink so that the image can be recorded on the paper P.

Further, as illustrated in FIG. 3, the printer 100 has ink receptacles 31Y, 31M, 31C, and 31K on the inner peripheral surface side of the first conveyor belt 8. When flushing is executed by the recording heads 17*a* to 17*c*, the ink receptacles 31Y to 31K receive and collect the ink discharged from the recording heads 17*a* to 17*c* and passed through the opening 80 of the first conveyor belt 8. Therefore, the ink receptacles 31Y to 31K are provided at positions facing the recording heads 17*a* to 17*c* of the line heads 11Y to 11K via the first conveyor belt 8. The ink collected by the ink receptacles 31Y to 31K is sent to, for example, a waste ink tank and discarded, or the ink may be reused without being discarded.

Here, flushing means ink ejection from the ink ejection port 18. at a time different from the time that contributes to image formation (image recording) on the paper P, for the purpose of reducing or preventing clogging of the ink ejection port 18 due to drying of the ink. The execution of flushing in the recording heads 17*a* to 17*c* is controlled by the controller 110.

The above-mentioned second conveyance unit 12 includes a second conveyor belt 12*a* and a dryer 12*b*. The second conveyor belt 12*a* is stretched on two driving rollers 12*c* and a driven roller 12*d*. The paper P is conveyed by the first conveyance unit 5, an image is recorded on the paper by ink ejection by the recording unit 9, the paper P is conveyed by the second conveyor belt 12*a*, dried by the dryer 12*b* during conveyance, and conveyed to the decurling section 14 described above.

2. Details of the First Conveyor Belt

2-1. Example of Configuration of the First Conveyor Belt

Figure 5:
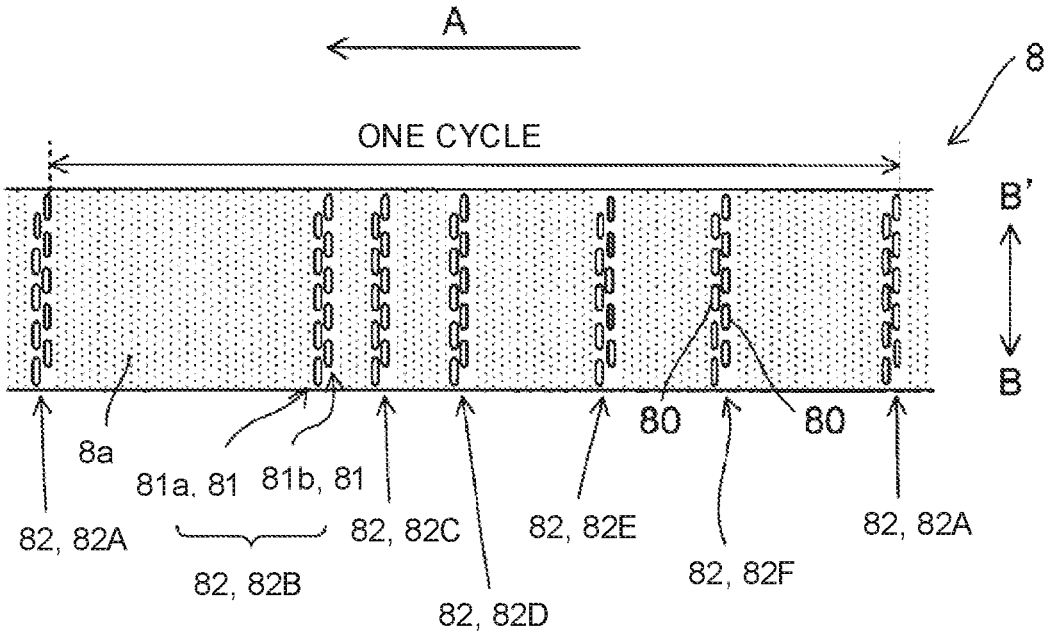
FIG. 5 is a plan view illustrating an example of a configuration of a first conveyor belt included in the first conveyance unit.

Next, the details of the first conveyor belt 8 of the first conveyance unit 5 will be described. FIG. 5 is a plan view illustrating an example of a configuration of the first conveyor belt 8. In the present embodiment, a negative pressure suction method is used in which the paper P is conveyed by attraction to the first conveyor belt 8 through negative pressure suction. Therefore, the first conveyor belt 8 is provided with innumerable suction holes 8*a* that allow passage of the suctioned air generated by the negative pressure suction.

Further, the first conveyor belt 8 is also provided with an opening group 82. The opening group 82 is a set of openings 80 which allow passage of ink ejected from each nozzle (ink ejection port 18) of the recording heads 17*a* to 17*c* during flushing. The opening area of one opening 80 is larger than the opening area of one suction hole 8*a*. The first conveyor belt 8 has, in one cycle, a plurality of opening groups 82 in the conveyance direction (A direction) of the paper P, and the present embodiment has six groups. Note that one cycle refers to a time period or distance in which the first conveyor belt 8 makes one revolution. When the opening groups 82 are distinguished from each other, the six opening groups 82 are referred to as opening groups 82A to 82F from the downstream side in the A direction. The suction holes 8*a* are positioned between each opening group 82 and the adjacent opening group 82 in the A direction. This means that in the first conveyor belt 8, the suction holes 8*a* are not formed in a region (around the opening 80) coinciding with an opening group 82.

The opening groups 82 are irregularly positioned in the A direction in one cycle of the first conveyor belt 8. That is, in the A direction, the interval between an opening group 82 and an adjacent opening group 82 is not constant but variable (there are at least two types of the above intervals). At this time, the maximum distance between the two opening groups 82 adjacent to each other in the A direction (for example, the distance between the opening group 82A and the opening group 82B in FIG. 5) is longer than the length of the paper P of the minimum printable size (for example, A4 size (horizontally placed)) in the A direction when it is placed on the first conveyor belt 8.

The opening group 82 has an opening row 81. The opening row 81 is configured by arranging a plurality of openings 80 in the belt width direction (paper width direction, BB' direction) orthogonal to the A direction. One opening group 82 has at least one opening row 81 in the A direction, and in the present embodiment, has two opening rows 81. To distinguish the two opening rows 81 from each other, one row is referred to as the opening row 81*a* and the other row is referred to as the opening row 81*b*.

In one opening group 82, the openings 80 of any opening row 81 (for example, opening row 81*a*) are positioned to be offset in the BB' direction with respect to the openings 80 of the other opening row 81 (for example, opening row 81*b*), and are positioned to coincide with a part of the opening 80 of another opening row 81 (for example, opening row 81*b*) when viewed in the A direction. Further, in each opening row 81, the plurality of openings 80 are positioned at equal intervals in the BB' direction.

By arranging the plurality of opening rows 81 in the A direction to form one opening group 82 as described above, the width of the opening group 82 in the BB' direction is longer than the width of the recording heads 17*a* to 17*c* in the BB' direction. Therefore, the opening group 82 covers the entire ink ejection region of the recording heads 17*a* to 17*c* in the BB' direction, and the ink ejected from all the ink ejection ports 18 of the recording heads 17*a* to 17*c* during flushing passes through any opening 80 of the opening group 82.

2-2. Pattern of Opening Groups Used when Flushing

In the present embodiment, the controller 110 drives the recording heads 17*a* to 17*c* to record an image on the paper P based on the image data transmitted from the outside (for example, a PC) while the first conveyor belt 8 conveys the paper P. At that time, by causing the recording heads 17*a* to 17*c* to perform flushing (flushing between sheets) between the conveyed paper P and the subsequent paper P clogging of the ink ejection port 18 is reduced or prevented.

Here, in the present embodiment, the controller 110 determines a pattern (combination) of a plurality of opening groups 82, in the A direction, used for flushing in one cycle of the first conveyor belt 8, according to the size of the paper P to be used. The size of the paper P to be used can be recognized by the controller 110 based on the information stored in the storage unit 28 (the size information of the paper P input by the operation panel 27*a*). Note that the pattern of the opening group 82 is worded differently from the placement pattern of the paper P described later.

Figure 6:
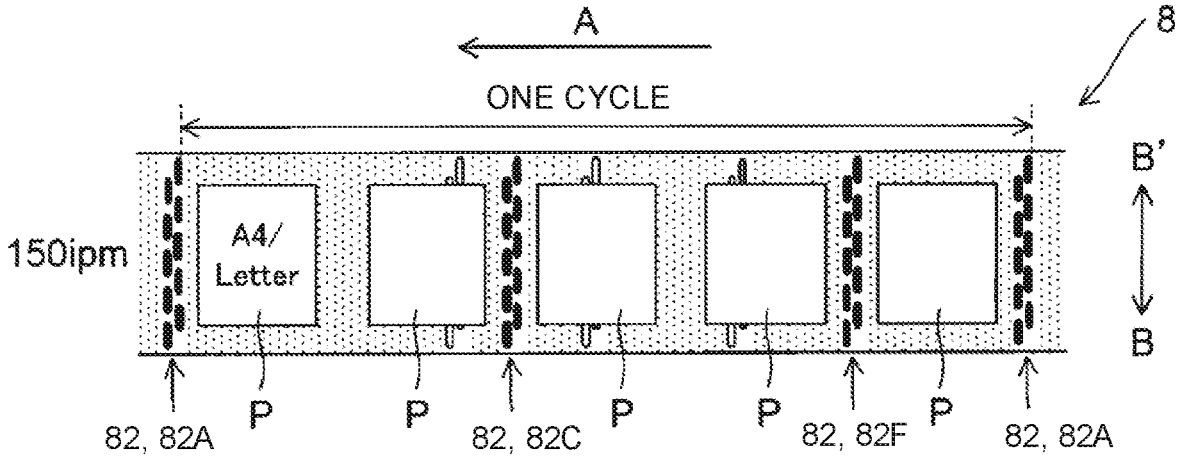
FIG. 6 is an explanatory diagram schematically illustrating an example of a pattern of a group of openings for flushing when the first conveyor belt of FIG. 5 is in use, and paper arranged on the first conveyor belt according to the pattern.
Figure 7:
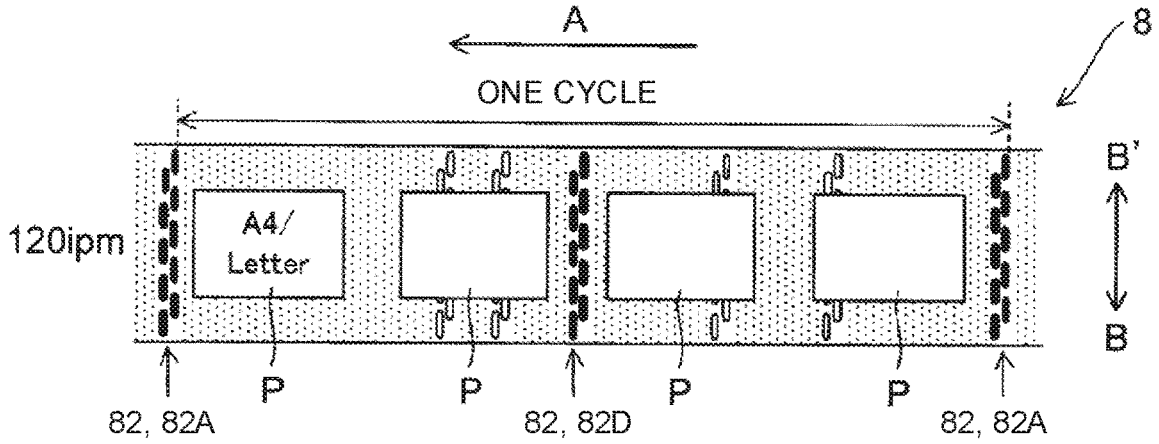
FIG. 7 is an explanatory diagram schematically illustrating another example of a pattern and paper arranged on the first conveyor belt according to the pattern.
Figure 8:
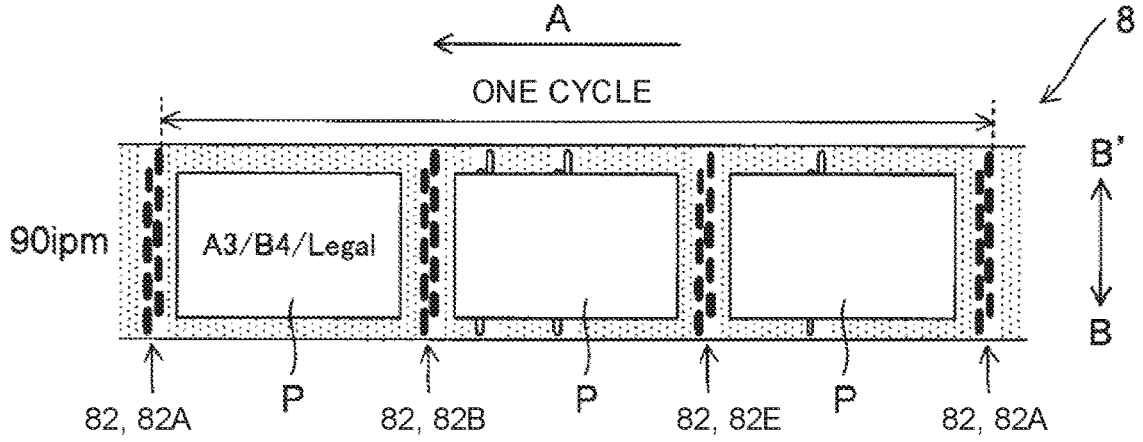
FIG. 8 is an explanatory diagram schematically illustrating yet another example of a pattern and paper arranged on the first conveyor belt according to the pattern.
Figure 9:
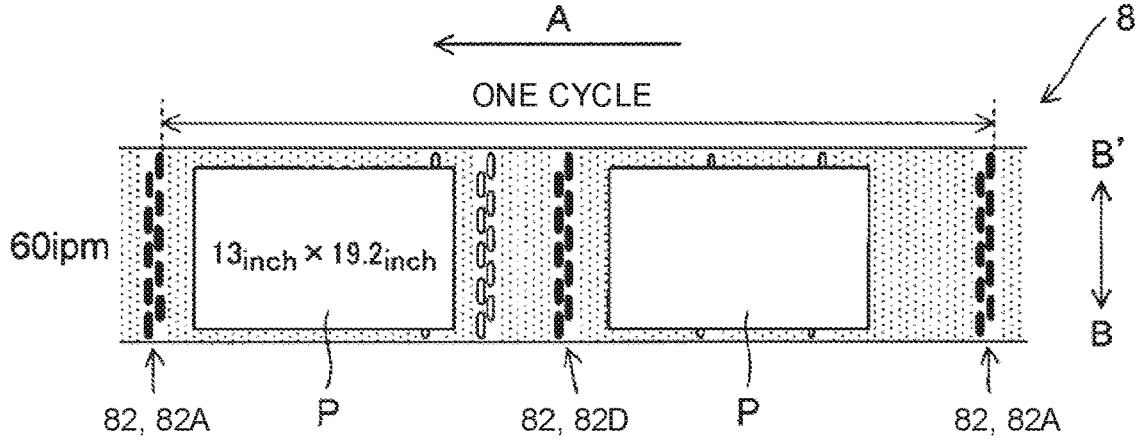
FIG. 9 is an explanatory diagram schematically illustrating yet another example of a pattern and paper arranged on the first conveyor belt according to the pattern.

FIGS. 6 to 9 each illustrate an example of a pattern of the opening group 82 for each paper P having a different size. For example, when the paper P to be used is A4 size (horizontally placed) or letter size (horizontally placed), the controller 110 selects the pattern of the opening group 82 shown in FIG. 6. That is, out of the six opening groups 82 shown in FIG. 5, the controller 110 selects the opening groups 82A, 82C, and 82F as the opening groups 82 to be used for flushing. When the paper P to be used is A4 size (vertically placed) or letter size (vertically placed), out of the six opening groups 82, the controller 110 selects the opening groups 82A and 82D as the opening groups 82 to be used for flushing, as shown in FIG. 7. When the paper P to be used is A3 size, B4 size, or legal size (all vertically placed), out of the six opening groups 82, the controller 110 selects the opening groups 82A, 82B, 82E as the opening groups 82 to be used for flushing, as shown in FIG. 8. When the paper P to be used has a size of 13 inches×19.2 inches, out of the six opening groups 82, the controller 110 selects groups 82A and 82D as the opening groups 82 to be used for flushing, as shown in FIG. 9. Note that in each drawing, the opening 80 of the opening group 82 belonging to the above pattern is shown in black for convenience.

Then, the controller 110 causes the recording heads 17*a* to 17*c* to execute flushing at the time when the opening group 82, positioned in the determined pattern, faces the recording heads 17*a* to 17*c* due to the traveling of the first conveyor belt 8. Here, the traveling speed of the first conveyor belt 8 (paper conveyance speed), the interval between the opening groups 82A to 82E, and the positions of the recording heads 17*a* to 17*c* with respect to the first conveyor belt 8 are all known. Therefore, if the belt sensor 24 or 25 detects that an opening group 82 (for example, the opening group 82A), serving as a reference, has passed due to the traveling of the first conveyor belt 8, it is possible to know after how many seconds from the time of detection the opening groups 82A to 82E will pass through positions that face the recording heads 17*a* to 17*c*. Therefore, based on the detection result of the belt sensors 24 or 25, the controller 110 causes the recording heads 17*a* to 17*c* to execute flushing at the time when the opening group 82, positioned in the pattern determined above, faces the recording heads 17*a* to 17*c*.

Further, the controller 110 controls the supply of the paper P to the first conveyor belt 8 so as to be offset in the A direction with respect to the opening group 82, which is positioned in the determined pattern. That is, the controller 110 supplies the paper P using the pair of registration rollers 13 between the plurality of opening groups 82 arranged in the A direction in the above pattern on the first conveyor belt 8.

For example, when the paper P to be used is A4 size (horizontally placed) or letter size (horizontally placed), as shown in FIG. 6, the controller 110 controls the pair of registration rollers 13 to supply the paper P at specific supply timing onto the first conveyor belt 8, to place two sheets of paper between opening group 82A and opening group 82C, to place two sheets of paper between opening group 82C and the opening group 82F, and to place one sheet of paper between opening group 82F and opening group 82A (in the next cycle), on the first conveyor belt 8. At this time, the controller 110 controls the pair of registration rollers 13 to supply the paper P onto the first conveyor belt 8 so each paper P can be arranged at a position separated by a specific distance or more in the A direction (including both the upstream side and the downstream side) from the opening groups 82A, 82C, and 82F, which are positioned in a pattern on the first conveyor belt 8. The specific distance is set to 10 mm as an example.

Here, the supply timing of the paper P by the pair of registration rollers 13 can be determined by the controller 110 based on the detection result of the belt sensor 24 or 25. For example, when the belt sensor 25 detects that an opening group 82 (for example, the opening group 82A), serving as a reference, has passed due to the traveling of the first conveyor belt 8, the controller 110 can determine how many seconds from the time of detection the paper P should be supplied to the first conveyor belt 8 by the pair of registration rollers 13 to arrange the paper P at each position shown in FIG. 6. Therefore, the controller 110 determines the supply timing of the paper P based on the detection result of the belt sensor 25, and controls the pair of registration rollers 13 so that the paper P is supplied at the determined supply timing. As a result, the paper P can be arranged at each position shown in FIG. 6 on the first conveyor belt 8 at approximately equal intervals. In the example in FIG. 6, five sheets of paper P can be conveyed in one cycle of the first conveyor belt 8, and 150 ipm (images per minute) can be achieved as a number of prints (productivity) on paper P per minute.

When the paper P to be used is A4 size (vertically placed) or letter size (vertically placed), the controller 110 controls the pair of registration rollers 13 to supply the paper P at a specific supply timing onto the first conveyor belt 8 to place two sheets of paper P between an opening group 82A and an opening group 82D, and to place two sheets of paper P between the opening group 82D and the opening group 82A (in the next cycle), on the first conveyor belt 8, as shown in FIG. 7. In the example in FIG. 7, four sheets of paper P can be conveyed in one cycle of the first conveyor belt 8, and a productivity of 120 ipm can be achieved.

When the paper P to be used is A3 size, B4 size, or legal size (all vertically placed), as shown in FIG. 8, the controller 110 controls the pair of registration rollers 13 to supply the paper P at specific supply timing onto the first conveyor belt 8, to place one sheet of paper P between the opening 82A and the opening group 82B, one sheet of paper P between the opening group 82B and the opening group 82E, and one sheet of paper P between the opening group 82E and the opening group 82A (in the next cycle), on the first conveyor belt 8. In the example in FIG. 8, three sheets of paper P can be conveyed in one cycle of the first conveyor belt 8, and a productivity of 90 ipm can be achieved.

When the paper P to be used has a size of 13 inches×19.2 inches, as shown in FIG. 9, the controller 110 controls the pair of registration rollers 13 to supply the paper P at specific supply timing onto the first conveyor belt 8 to place one sheet between the opening group 82A and the opening group 82D, and to place one sheet of paper P between the opening group 82D and the opening group 82A (in the next cycle), on the first conveyor belt 8. In the example in FIG. 9, two sheets of paper P can be conveyed in one cycle of the first conveyor belt 8, and a productivity of 60 ipm can be achieved.

That is, as shown in FIGS. 6 to 9, the pattern of the opening group 82 used for flushing is determined according to the size of the paper P to be used and the placement pattern of the positioned paper P is determined which is offset from the opening group 82 in the A direction. From this, the placement pattern of the paper P placed on the first conveyor belt 8 can be said to be determined according to the size of the paper P to be used. Further, the flushing time can be said to be determined by the size of the paper P, the productivity, and the position of the opening group 82 (opening 80) in the A direction.

3. Basic Concept of Flushing Control and Paper Supply Control to the First Conveyor Belt Normally, by supplying the paper P to the first conveyor belt 8 and placing the paper P as shown in FIGS. 6 to 9, the opening group 82 (opening 80) determined according to the size of the paper P can be used for flushing.

Figure 10:
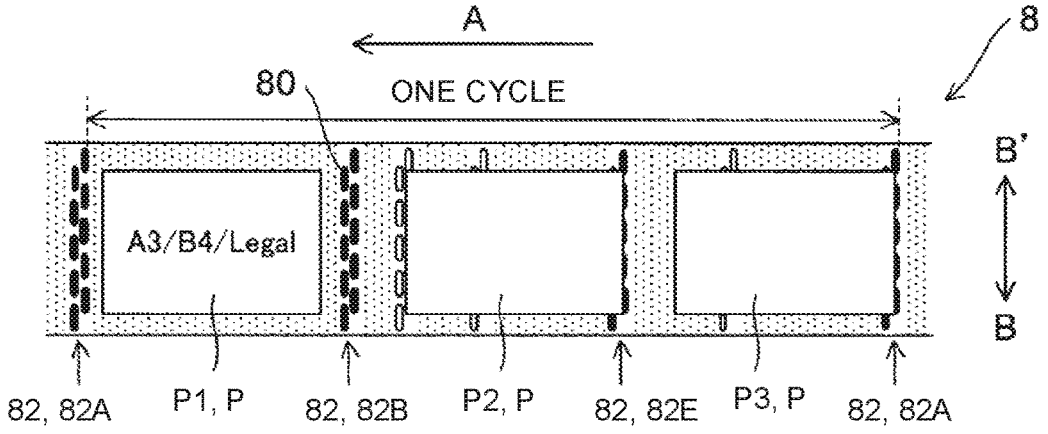
FIG. 10 is an explanatory diagram schematically illustrating the placement position of each sheet of paper on the first conveyor belt when a plurality of sheets are sequentially supplied to the first conveyor belt and when a conveyance delay occurs for the second and subsequent sheets of paper.

However, if a slip of the paper P or the like occurs during the conveyance of the paper P and the supply of the paper P is delayed, the paper P may be placed coinciding with the opening group 82 of the first conveyor belt 8. FIG. 10 schematically illustrates the placement positions of the sheets of paper P1 to P3 (for example, A3 size) on the first conveyor belt 8 when the sheets of paper P1 to P3 are sequentially supplied to the first conveyor belt 8 and a conveyance delay occurs for the second and subsequent sheets of paper P2 and P3. As shown in the figure, due to the conveyance delay, the second sheet of paper P2 is placed on the first conveyor belt 8 so as to coincide with the opening group 82E used for flushing. In this case, if the recording heads 17*a* to 17*c* are caused to execute flushing at the time of facing opening group 82E, the ink ejected at the time of flushing adheres to the paper P2, and the image quality of the image formed on the paper P2 deteriorates. Therefore, it is necessary to stop the flushing. However, when flushing using the opening group 82E is stopped, since flushing does not occur before image formation on the third sheet of paper P3 (between the sheets between the second sheet of paper P2 and the third sheet of paper P3), there is a possibility that clogging due to drying of the ink may occur at any of the ink ejection ports 18 before the image is formed on the paper P3. As a result, it may not be possible to satisfactorily form an image on the paper P3.

Figure 11:
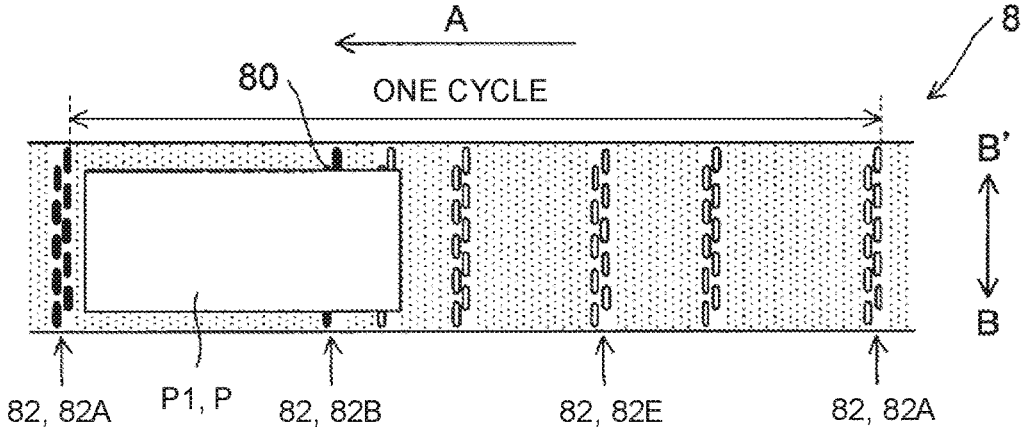
FIG. 11 is an explanatory diagram schematically illustrating a state in which paper longer in the conveyance direction than a set size is supplied and arranged on the first conveyor belt.

FIG. 11 schematically illustrates a state in which a paper P1, longer in the conveyance direction than a set size (for example, A3 size) is supplied and arranged on the first conveyor belt 8. As shown in the figure, when the size of the paper P1 actually supplied to the first conveyor belt 8 is larger than the set size (for example, A3 size), since the paper P1 is placed so as to cover the opening group 82B for flushing, which is determined according to the set size, it is necessary to stop flushing using the opening group 82B in order to avoid deterioration of the image quality of the paper P1. If the flushing is stopped, before the image is formed on the subsequent paper, clogging may occur at one of the ink ejection ports 18 due to drying of the ink and the image formation on the subsequent paper may not be performed satisfactorily.

Therefore, in the present embodiment, based on the detection result of the trailing edge of the paper P by the registration sensor 21 and the detection result of the opening group 82 (opening 80) by the belt sensor 25, the controller 110 determines whether the paper P, supplied to the first conveyor belt 8 by the pair of registration rollers 13, coincides with the opening group 82 for flushing that moves due to the traveling of the first conveyor belt 8 when placed on the first conveyor belt 8. Note that the trailing edge of the paper P is the edge on the upstream side in the conveyance direction of the paper P (A direction, supply direction). On the other hand, the leading edge of the paper P is the edge on the downstream side in the conveyance direction of the paper P.

Then, for example, as shown in FIGS. 6 to 9, when the paper P does not coincide with the opening 80 for flushing when placed on the first conveyor belt 8, that is, when the flushing opening 80 is positioned after the trailing edge of the preceding paper P (on the upstream side), and the controller 110 causes the recording heads 17*a* to 17*c* to perform flushing using the opening 80. Since the paper P does not coincide with the opening 80 for flushing, even if the opening 80 is used to perform flushing, the ink for flushing does not adhere to the paper P, and it is possible to avoid deterioration of the image quality of the recorded image of the paper P. Further, by performing flushing, good quality ink can be ejected from the recording heads 17*a* to 17*c* in image formation onto the subsequent paper P, and the image formation can be performed satisfactorily. When the paper P does not coincide with the flushing opening 80 when placed on the first conveyor belt 8, the supply of the subsequent paper P to the first conveyor belt 8 may be delayed, as will be described later (see, for example, 4-1-2b).

On the other hand, when the paper P is placed on the first conveyor belt 8 coinciding with the opening 80 for flushing, that is, the flushing opening 80 is positioned before (the downstream side of) the trailing edge of the preceding paper P, the controller 110 stops flushing using the opening 80 and controls the pair of registration rollers 13 to delay the supply of the subsequent paper P to the first conveyor belt 8.

Figure 12:
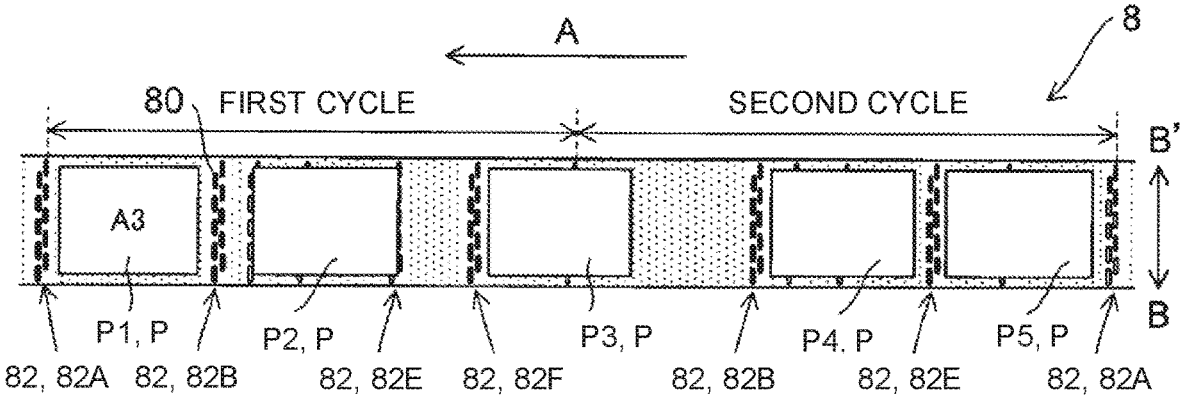
FIG. 12 is an explanatory diagram schematically illustrating an example of a placement position of a subsequent paper when a preceding paper placed on the first conveyor belt coincides with the opening group used for flushing.

FIG. 12 schematically illustrates the placement position when the supply of the subsequent P3 to P5 to the first conveyor belt 8 is delayed when, for example, the conveyance of the sheet of paper P2 to the first conveyor belt 8 is delayed during conveyance due to slipping or the like, and the sheet of paper P2 coincides with the opening group 82E for flushing. In the example of the figure, so that the leading edge of the subsequent paper P3 is positioned after the opening group 82F (upstream side) in the first cycle of the first conveyor belt 8, based on the detection result of the opening group 82F of the belt sensor 25, the pair of registration rollers 13 are controlled to supply the subsequent paper P3 to the first conveyor belt 8. Further, with respect to the subsequent sheets P4 and P5, the pair of registration rollers 13 are controlled to supply the subsequent sheets P4 and P5 onto the first conveyor belt 8 based on the detection results of the groups 82B and 82E by the belt sensor 25 so that the respective leading edges of the sheets P4 and P5 are positioned after the opening groups 82B and 82E in the second cycle of the first conveyor belt 8.

As described above, by stopping the flushing using the opening 80 (first opening) of the opening group 82E coinciding with the preceding paper P2, it is possible to avoid deterioration of the image quality of the recorded image of the preceding paper P2 due to ink ejected by the flushing adhering to the preceding paper P2. Further, by controlling the pair of registration rollers 13 to delay the supply of the subsequent sheets P3 to P5 to the first conveyor belt 8, the subsequent sheets of paper P3 to P5 can be placed after another opening 80 (on the upstream side) as a second opening on the first conveyor belt 8 (for example, the opening 80 of the opening groups 82F, 82B or 82E). The second opening is an opening 80 detected after the first opening by the belt sensor 25. As a result, it is possible to perform flushing using the other opening 80 before forming an image on the subsequent sheets P3 to P5 and image formation on the subsequent sheets P3 to P5 can be performed satisfactorily. As a result, it becomes possible to realize consistent image quality for all the printed sheets of paper P1 to P5.

That is, even when the preceding paper P is, for some reason, placed so as to coincide with the opening 80 of the first conveyor belt 8, by appropriately controlling the execution of the flushing by the recording heads 17*a* to 17*c* and the supply of the subsequent paper P by the pair of registration rollers 13 to the first conveyor belt, deterioration of the image quality of the recorded image of the preceding paper P can be avoided, and an opportunity to perform flushing before forming an image on the subsequent paper P is secured without fail, so the image formation on the subsequent paper P can be performed satisfactorily.

Further, even when the preceding paper P and the flushing opening 80 coincide, it is not necessary to end the image formation on the subsequent sheets of paper P3 to P5 for the reason that the flushing cannot be executed, and productivity can be ensured by continuing image formation on the subsequent sheets of paper P3 to P5. Moreover, by the pair of registration rollers 13 controlling the supply of the sheets of paper P3 to P5 so that the leading edges of the sheets of paper P3 to P5 are each positioned after the other openings 80, deterioration in production due to delay in the supply of the sheets of paper P3 to P5 can be minimized.

In particular, when the controller 110 determines that the preceding paper P2 coincides with the opening 80 (first opening) of the opening group 82E for flushing when placed on the first conveyor belt 8, the controller stops the execution of flushing by the recording heads 17*a* to 17*c* at the time when facing the opening 80 due to the traveling of the first conveyor belt 8, and the controller 110 causes the pair of registration rollers 13 to supply the subsequent paper P3 to the first conveyor belt 8, so that the subsequent paper P3 is placed in the upstream side of the opening 80 (second opening) of the other opening group 82F which is detected by the belt sensor 25 after detection of the first opening and moves by the traveling of the first conveyor belt 8. Then, at the time when facing the second opening due to the traveling of the first conveyor belt 8, the flushing by recording heads 17*a* to 17*c* is executed.

By stopping the flushing using the opening 80 coinciding with the preceding paper P2, it is possible to avoid deterioration of the image quality of the recorded image of the paper P2 due to flushing. Further, since an opportunity to perform flushing using the second opening is secured before image formation on the subsequent paper P3, the above flushing can be executed to perform favorable image formation on the subsequent paper P3.

Figure 13:
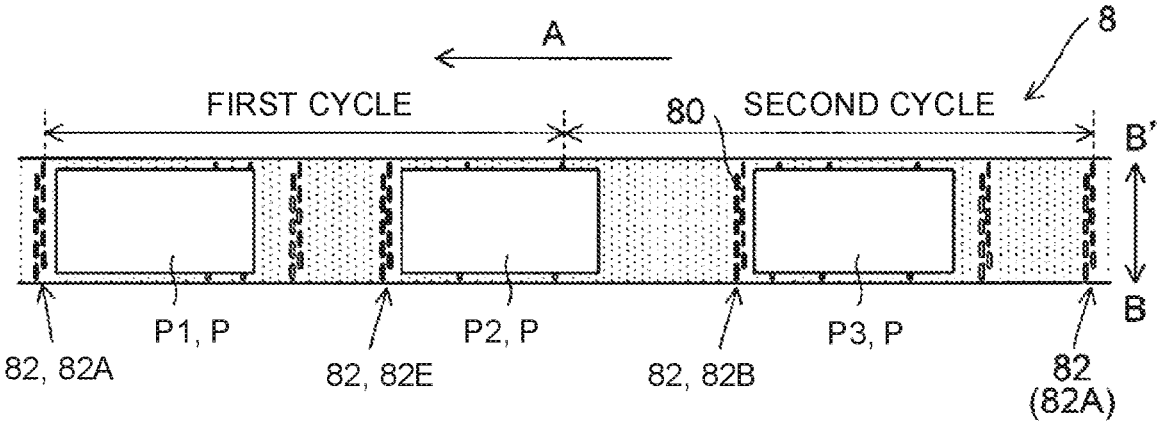
FIG. 13 is an explanatory diagram schematically illustrating another example of a placement position of a subsequent paper when a preceding paper placed on the first conveyor belt coincides with the opening group used for flushing.

FIG. 13 schematically illustrates a placement state in which paper P1, longer in the conveyance direction than the set size (for example, A3 size), is placed on the first conveyor belt 8 so as to cover the opening 80 of the opening group 82B according to the set size, and the placement when the supply of the subsequent sheets of paper P2 and P3 onto the first conveyor belt 8 is delayed. In the example of the figure, so that the leading edge of the subsequent paper P2 is positioned after the opening group 82E (upstream side) in the first cycle of the first conveyor belt 8, based on the detection result of the opening group 82E of the belt sensor 25, the pair of registration rollers 13 is controlled to supply the subsequent paper P2 to the first conveyor belt 8. Further, by controlling the pair of registration rollers 13 based on the detection result of the opening group 82B by the belt sensor 25, the subsequent paper P3 is supplied to the first conveyor belt 8 so that the leading edge of the subsequent paper P3 is positioned after the opening group 82B in the second cycle of the first conveyor belt 8.

In this way, when the paper P1 larger than the set size is placed on the first conveyor belt 8, even if the opening 80 (first opening) of the opening group 82B used for flushing of that set size is covered by the paper P1, by controlling the supply of the subsequent sheets of paper P2 and P3 as described above, it is possible to avoid deterioration of the image quality of the recorded image of the preceding paper P1. Before image formation on the subsequent sheets of paper P2 and P3, by performing flushing using the opening 80 (second opening) from the other opening groups 82E and 82B, the image formation on subsequent sheets of paper P2 and P3 can be performed satisfactorily, and effects similar to the above can be obtained.

4. Specific Control of Flushing and Paper Supply

Hereinafter, specific control of flushing of the recording heads 17*a* to 17*c* and supply of the paper P to the first conveyor belt 8 will be described. Here, a first detection sensor that detects the paper P by being positioned on the upstream side of the pair of registration rollers 13 in the supply direction of the paper P is described as a registration sensor 21, but the first detection sensor may be any sensor that is arranged between the paper feeder 3 and the pair of registration rollers 13 to detect the paper P, and is not limited to the above-mentioned registration sensor 21.

In the following, among the openings 80 of the different opening groups 82 of the first conveyor belt 8 detected by the belt sensor 25, an opening 80 detected first is also referred to as the first opening 80*a*, and an opening 80 detected later is also referred to as a second opening 80*b*. Therefore, in the first conveyor belt 8, the second opening 80*b* is positioned on the upstream side of the first opening 80*a* in the belt traveling direction. The second opening 80*b* may be an opening 80 that appears first in the upstream side of the first opening 80*a*, or may be an opening 80 that appears second or later.

4-1. When A<B<C

Figure 14:
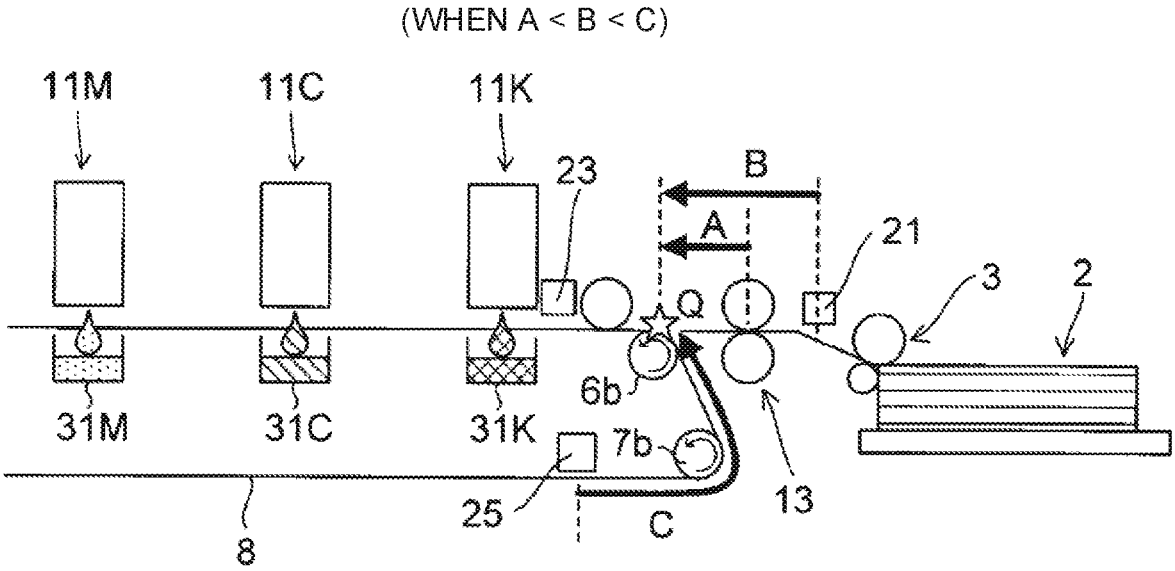
FIG. 14 is an explanatory diagram schematically illustrating an example of the positional relationships among a pair of registration rollers, a registration sensor, and a belt sensor in the printer.

FIG. 14 schematically shows an example of the positional relationship between the pair of registration rollers 13, the registration sensor 21, and the belt sensor 25. For convenience of explanation below, the point where the paper P supplied toward the first conveyor belt 8 by the pair of registration rollers 13 merges with the first conveyor belt 8 is set as the merging position Q (illustrated by a star mark). Then, the conveyance distance of the paper P from the pair of registration rollers 13 to the merging position Q is A (mm), the conveyance distance of the paper P from the detection position of the registration sensor 21 to the merging position Q is B (mm), and the conveyance distance of the first conveyor belt 8 from the detection position of the belt sensor 25 the merge position Q to, that is, movement distance of the opening 80 (first opening 80*a* or second opening 80*b*) from the detection position to the merging position Q due to the travel of the first conveyor belt 8 is C (mm). It is assumed all of these are known. Further, the traveling speed of the first conveyor belt 8 is also known, and it is assumed that the traveling speed is equal to the supply speed of the paper P supplied from the paper feeder 3 to the first conveyor belt 8 via the pair of registration rollers 13.

As shown in the figure, when the pair of registration rollers 13, the registration sensor 21 and the belt sensor 25 are arranged so as to have an A<B<C relationship, the flushing control and the paper P supply control are classified into three cases as follows.

Figure 15:
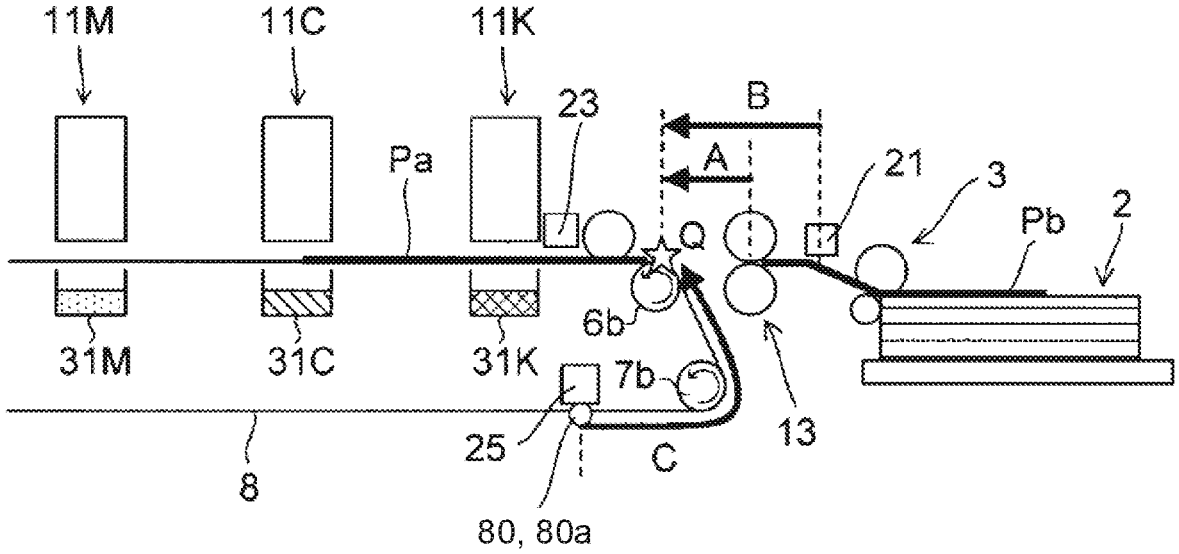
FIG. 15 is an explanatory diagram schematically illustrating an example of the positional relationship among the pair of registration rollers, the registration sensor, a preceding paper and a subsequent paper, and an opening of the first conveyor belt in the configuration of FIG. 14.

4-1-1. Detection of the Trailing Edge of the Preceding Paper, Leading Edge of the Subsequent Paper Reaches Pair of Registration Rollers FIG. 15 schematically illustrates a state in which the registration sensor 21 has already detected the trailing edge of the preceding paper Pa, and when the belt sensor 25 has detected the first opening 80*a* for flushing, the leading edge of the subsequent paper Pb has reached the pair of registration rollers 13. It is assumed that the pair of registration rollers 13 are stopped. As described above, since the conveyance distances A and B are known, the conveyance distance of the paper Pb from the registration sensor 21 to the pair of registration rollers 13 can be obtained. Since the conveyance speed of the paper Pb by the paper feeder 3 or the like is also known, the controller 110 can determine how many seconds after the registration sensor 21 detects the leading edge of the paper Pb the leading edge of the paper Pb will reach the pair of registration rollers 13.

Therefore, when the controller 110 determines that the leading edge of the subsequent paper Pb has reached the pair of registration rollers 13, based on the detection of the leading edge of the subsequent paper Pb by the registration sensor 21 when the trailing edge of the preceding paper Pa has already been detected by the registration sensor 21 and at the point in time when the belt sensor 25 detects the first opening 80*a* for flushing, the controller 110 causes the pair of registration rollers 13 to supply the subsequent paper Pb to the first conveyor belt 8 (starting the second paper supply), and causes the recording heads 17*a* to 17*c* to execute flushing at the time when facing the first opening 80*a* due to the traveling of the first conveyor belt 8, after the first opening 80*a* has moved the distance of (C−A) due to the traveling of the first conveyor belt 8.

When the subsequent paper Pb is supplied to the first conveyor belt 8 at the above time, the traveling of the first conveyor belt 8 can cause the first opening 80*a* for flushing of the first conveyor belt 8, to be positioned between the preceding paper Pa and the subsequent paper Pb. Therefore, by using the first opening 80*a* to perform flushing, since the ink ejected at the time of flushing does not adhere to the preceding paper Pa, it is possible to avoid deterioration of the image quality of the recorded image of the preceding paper Pa. Further, by performing flushing using the first opening 80*a* before forming an image on the subsequent paper Pb, image formation on the subsequent paper Pb can be performed satisfactorily.

Figure 16:
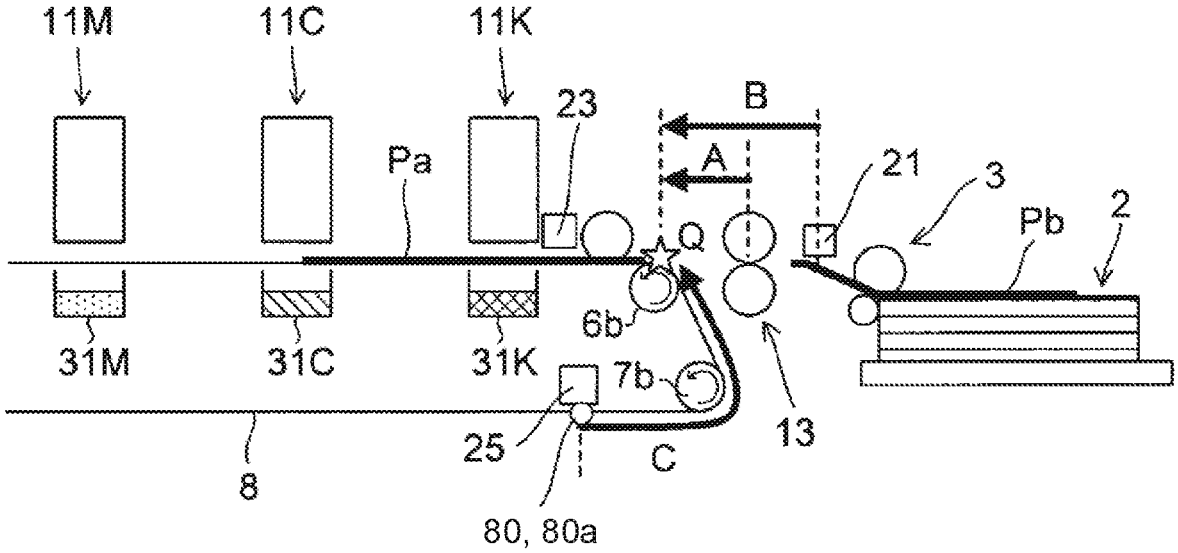
FIG. 16 is an explanatory diagram schematically illustrating another example of the above positional relationships.

4-1-2. Detection of the Trailing Edge of the Preceding Paper, when the Leading Edge of the Subsequent Paper has not Reached the Pair of Registration Rollers FIG. 16 schematically illustrates a state in which the registration sensor 21 has already detected the trailing edge of the preceding paper Pa, and at the time when the belt sensor 25 has detected the first opening 80*a* for flushing, the leading edge of the subsequent paper Pb has not reached the pair of registration rollers 13. When it is assumed that the leading edge of the subsequent paper Pb reaches the pair of registration rollers 13 t seconds after the registration sensor 21 detects the leading edge of the subsequent paper Pb, when less than t seconds have passed since the registration sensor 21 detected the leading edge of the subsequent paper Pb, the controller 110 determines that the leading edge of the subsequent paper Pb has not reached the pair of registration rollers 13. The flushing control in this case and the supply control of the subsequent paper Pb to the first conveyor belt 8 are further classified into the following two cases.

4-1-2a. When the Movement Amount D of the Opening is (C−A) or Less when the Leading Edge of the Subsequent Paper Reaches the Pair of Registration Rollers FIG. 17 schematically illustrates a state in which when the leading edge of the subsequent paper Pb has reached the pair of registration rollers 13, the movement amount D of the first opening 80*a* for flushing, due to the traveling of the first conveyor belt 8, detected by the belt sensor 25, is (C−A) or less.

Figure 17:
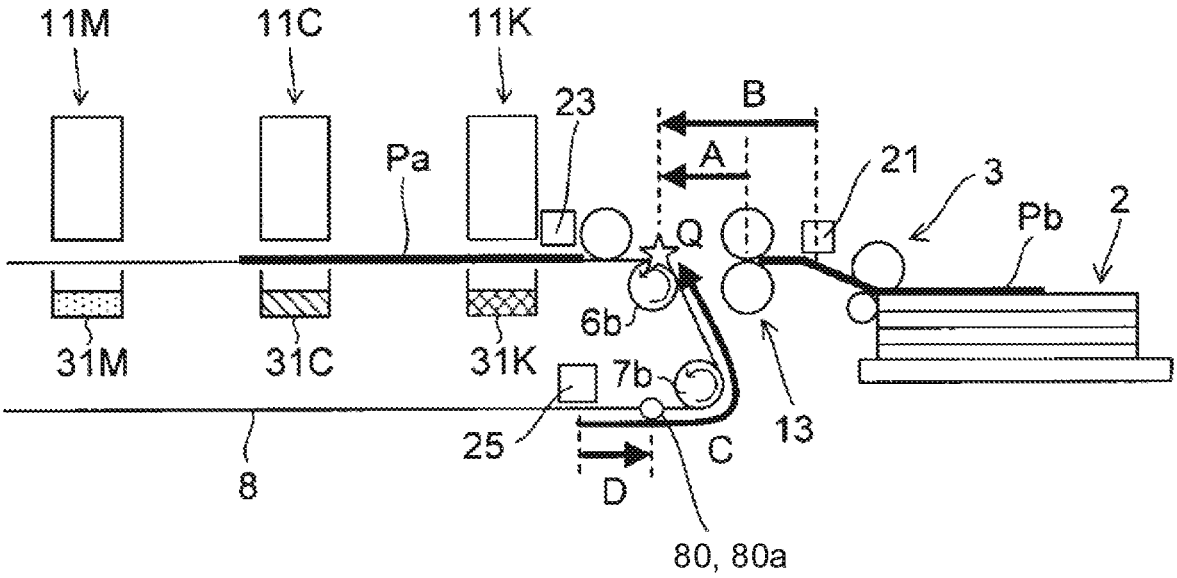
FIG. 17 is an explanatory diagram schematically illustrating yet another example of the above positional relationships.

When the trailing edge of the preceding paper Pa has already been detected by the registration sensor 21, based on the detection of the leading edge of the subsequent paper Pb by the registration sensor 21, after it is determined that the leading edge of the subsequent paper Pb has not reached the pair of registration rollers 13, as shown in FIG. 17, at a later point in time when the leading edge of the subsequent paper Pb reaches the pair of registration rollers 13, when the movement amount D of the first opening 80*a* from the detection position of the belt sensor 25 due to the traveling of the first conveyor belt 8, is (C−A) or less, the controller 110 performs the following control. That is, until the movement amount D of the first opening 80*a* exceeds (C−A) due to the traveling of the first conveyor belt 8, the controller 110 stops the supply of the subsequent paper Pb by the pair of registration rollers 13, and when the movement amount D exceeds (C−A), the controller 110 supplies the subsequent paper Pb to the first conveyor belt 8 by the pair of registration rollers 13, and at the time when the first opening 80*a* faces the recording heads 17*a* to 17*c*, the controller 110 causes the recording heads 17*a* to 17*c* to execute flushing. The movement amount D can be obtained from the product of the traveling speed of the first conveyor belt 8 and the elapsed time from when the belt sensor 25 detects the first opening 80*a* until the subsequent paper Pb reaches the pair of registration rollers 13.

In such a supply control of the subsequent paper Pb, after the first opening 80*a* for flushing has passed the merging position Q due to the traveling of the first conveyor belt 8, the subsequent paper Pb can be merged and placed onto the first conveyor belt 8. As a result, by performing flushing using the first opening 80*a* before forming an image on the subsequent paper Pb, image formation on the subsequent paper Pb can be performed satisfactorily.

4-1-2b. When the Movement Amount D of the Opening Exceeds (C−A) when the Leading Edge of the Subsequent Paper Reaches the Pair of Registration Rollers FIG. 18 schematically illustrates a state in which the movement amount D of the first opening 80*a* for flushing detected by the belt sensor 25 exceeds (C−A) due to the traveling of the first conveyor belt 8, when the leading edge of the subsequent paper Pb reaches the pair of registration rollers 13.

Figure 18:
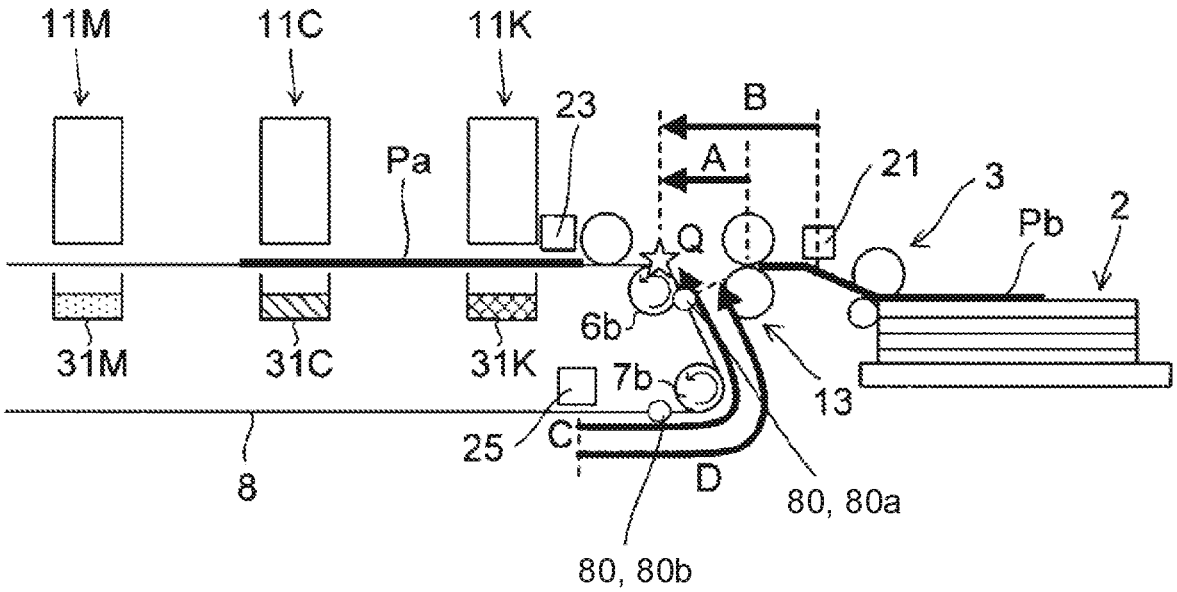
FIG. 18 is an explanatory diagram schematically illustrating yet another example of the above positional relationships.

When the trailing edge of the preceding paper Pa has already been detected by the registration sensor 21, based on the detection of the leading edge of the subsequent paper Pb by the registration sensor 21, when it is determined that the leading edge of the subsequent paper Pb has not reached the pair of registration rollers 13, the controller 110 later performs the following control, when, as shown in FIG. 18, at the point in time when the leading edge of the subsequent paper Pb reaches the pair of registration rollers 13, when the movement amount D of the first opening 80*a*, from the detection position of the belt sensor 25 due to the traveling of the first conveyor belt 8 exceeds (C−A). That is, after the second opening 80*b* of the other opening group 82 is detected by the belt sensor 25, until the second opening 80*b* moves the distance (C−A) due to the traveling of the first conveyor belt 8 the controller stops the supply of the subsequent paper Pb by the pair of registration rollers 13, and after the movement amount exceeds (C−A), the controller 110 causes the pair of registration rollers 13 to supply the subsequent paper Pb to the first conveyor belt 8 by, and at the time when the second opening 80*b* faces the recording heads 17*a* to 17*c*, causes the recording heads 17*a* to 17*c* to execute flushing.

For example, when, at the point in time when the leading edge of the subsequent paper Pb reaches the pair of registration rollers 13, the movement amount D of the first opening 80*a* for flushing, due to the traveling of the first conveyor belt 8, detected by the belt sensor 25, exceeds (C−A), it is possible to place the first opening 80*a* near the merging position Q. In such a case, when the supply of the subsequent paper Pb to the first conveyor belt 8 (second paper supply) by the pair of registration rollers 13 is started, the interval between the first opening 80*a* and the subsequent paper in the first conveyor belt 8 is too wide, so even if flushing is performed using the first opening 80*a*, the ink in the ink ejection port 18 may dry in the time period until the next image formation on the subsequent paper Pb, and the effect of flushing may be reduced.

When the movement amount D of the first opening 80*a*, which is detected first, exceeds (C−A), after the second opening 80*b* is detected by the belt sensor 25 and the distance (C−A) is moved due to the traveling of the first conveyor belt 8, the subsequent paper Pb is supplied onto the first conveyor belt 8 by the pair of registration rollers 13, so that the subsequent paper Pb can be placed on the upstream side of and immediately after the second opening 80*b* in the first conveyor belt 8. As a result, by performing flushing using the second opening 80*b* immediately before forming an image on the subsequent paper Pb, image formation on the subsequent paper Pb can be performed satisfactorily. Further, in the first conveyor belt 8, by narrowing the distance between the second opening 80*b* and the subsequent paper Pb, the interval between the opening 80 and the paper P is set to be easily constant for any paper 80 and it becomes easier to keep the time of flushing using the opening P and the time of image formation on the paper P constant. As a result, ink ejection control for the recording heads 17*a* to 17*c* becomes easier The control of the controller 110 in 4-1-2a and 4-1-2b described above can be summarized as follows. That is, when the controller 110 determines that the preceding paper Pa is placed on the first conveyor belt 8 without coinciding with the first opening 80*a* (offset in the conveyance direction), based on the position of the first opening 80*a* at the point in when the leading edge of the subsequent paper Pb reaches the pair of registration rollers 13 (based on whether the movement amount D of the first opening 80*a* is (C−A) or less), the controller determines whether the paper Pb is to be placed on the upstream side of the first opening 80*a* or on the upstream side of the second opening 80*b*, and at a time based on the determination result, causes the pair of registration rollers 13 to supply subsequent paper Pb onto the first conveyor belt 8, and between first opening 80*a* and second opening 80*b*, causes the recording heads 17*a* to 17*c* to perform flushing at a time when facing the opening 80 closest to the subsequent paper Pb placed on the first conveyor belt 8. Since flushing can be performed using the first opening 80*a* or the second opening 80*b* immediately before image formation on the subsequent paper Pb, a state having the maximum effect of flushing is maintained, and image formation on the subsequent paper Pb can be performed satisfactorily.

4-1-3. When the Trailing Edge of the Preceding Paper is not Detected

Figure 19:
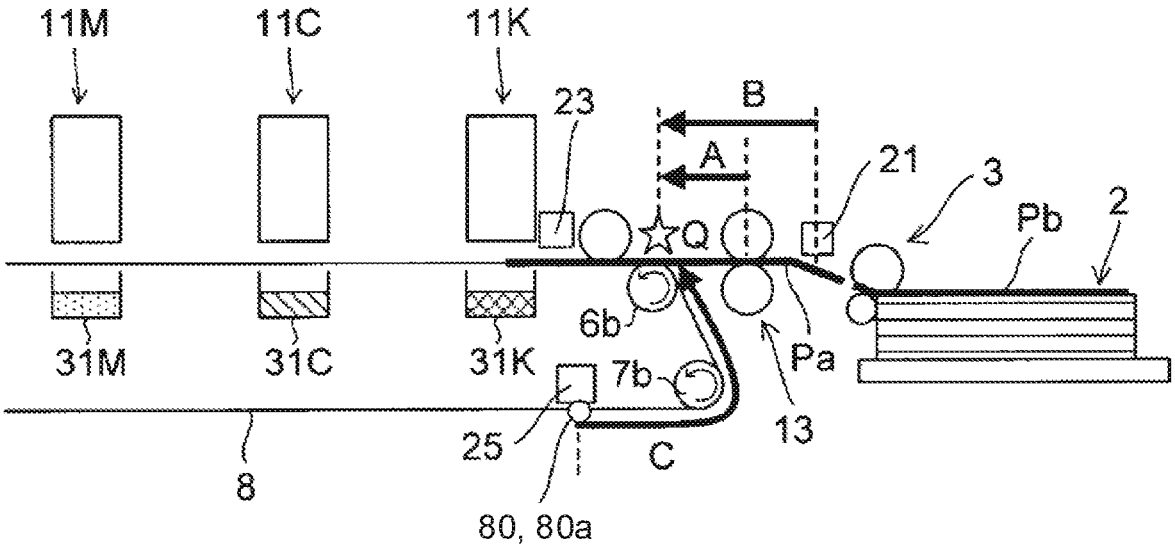
FIG. 19 is an explanatory diagram schematically illustrating yet another example of the above positional relationships.

FIG. 19 schematically illustrates a state in which the registration sensor 21 does not detect the trailing edge of the preceding paper Pa at the time when the belt sensor 25 detects the opening 80. The flushing control in this case is further classified into the following two cases.

Figure 20:
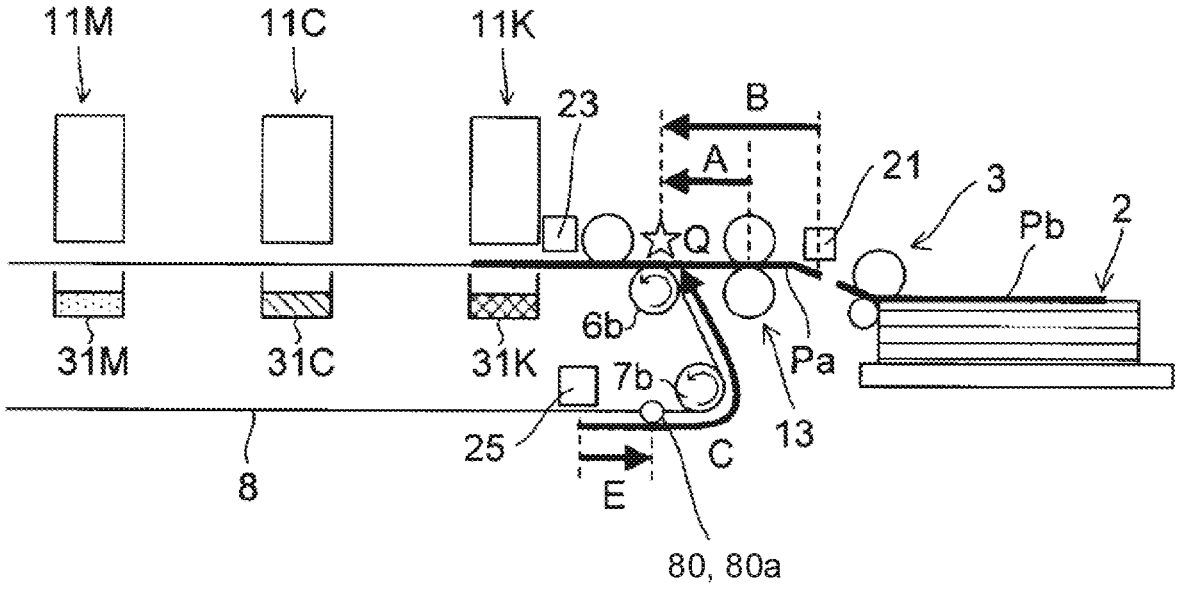
FIG. 20 is an explanatory diagram schematically illustrating yet another example of the above positional relationships.

4-1-3a. When the Movement Amount E of the Opening is Less than (C−B) when the Trailing Edge of the Preceding Paper Reaches the Registration Sensor FIG. 20 schematically illustrates a state in which, when the trailing edge of the preceding paper Pa reaches the registration sensor 21, the movement amount E of the first opening 80*a* for flushing, due to the traveling of the first conveyor belt 8, and which is detected by the belt sensor 25 is less than (C−B).

After the controller 110 determines that the trailing edge of the preceding paper Pa has not been detected by the registration sensor 21, at a later point in time when the trailing edge of the preceding paper Pa is detected by the registration sensor 21, when the movement amount E of the first opening 80*a* from the detection position of the belt sensor 25 due to traveling of the first conveyor belt 8 is less than (C−B), so the subsequent paper is placed on the upstream side of the first opening 80*a*, the controller 110 causes the pair of registration rollers 13 to supply the subsequent paper Pb onto the first conveyor belt 8, and at the time when the first opening 80*b* faces the recording heads 17*a* to 17*c*, causes the recording heads 17*a* to 17*c* to execute flushing. The movement amount E can be obtained from the product of the traveling speed of the first conveyor belt 8 and the elapsed time from when the belt sensor 25 detects the first opening 80*a* until the trailing edge of the preceding paper Pa is detected by the registration sensor 21.

In this case, even after the registration sensor 21 detects the trailing edge, if the preceding paper Pa moves by the distance B, the first opening 80*a* does not catch up with the preceding paper Pa, and therefore, the preceding paper Pa will not be positioned coinciding with the first opening 80*a* on the first conveyor belt 8. Therefore, by using the first opening 80*a* to cause the recording heads 17*a* to 17*c* to execute flushing, it is possible to avoid deterioration of the image quality of the recorded image of the preceding paper Pa. Further, since flushing is executed using the first opening 80*a* before the image formation on the subsequent paper Pb, image formation on the subsequent paper Pb can be performed satisfactorily.

Figure 21:
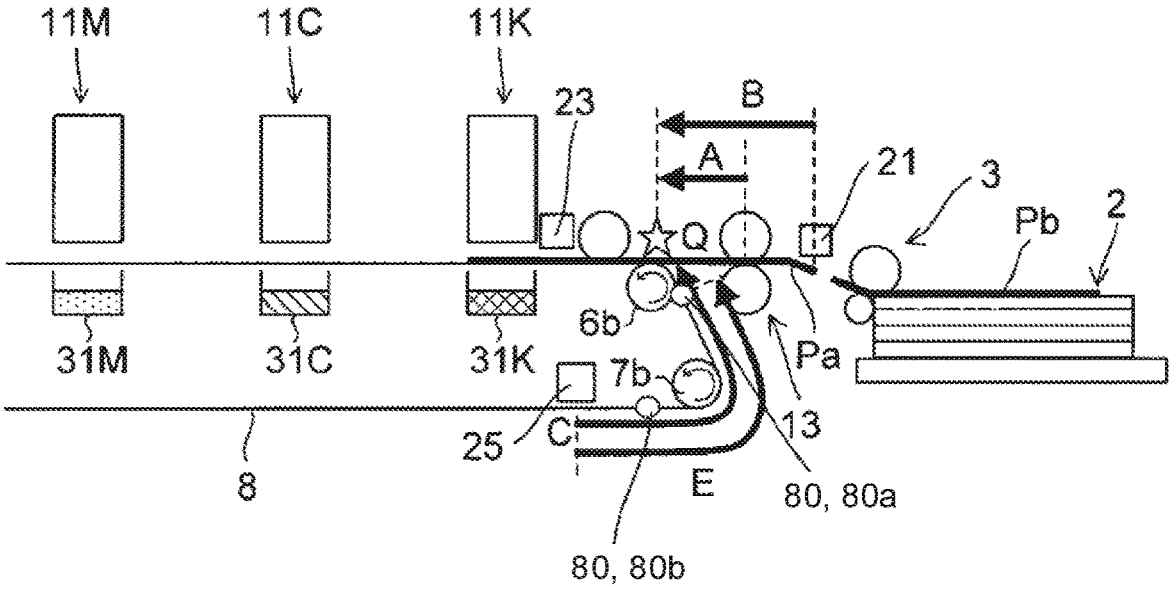
FIG. 21 is an explanatory diagram schematically illustrating yet another example of the above positional relationships.

4-1-3b. When the Movement Amount E of the Opening is (C−B) or More when the Trailing Edge of the Preceding Paper Reaches the Registration Sensor FIG. 21 schematically illustrates a state when, when the trailing edge of the preceding paper Pa reaches the registration sensor 21, the movement amount E of the first opening 80*a* for flushing due to the traveling of the first conveyor belt 8 detected by the belt sensor 25 is (C−B) or more.

After the controller 110 determines that the trailing edge of the preceding paper Pa has not been detected by the registration sensor 21, at the point in time when the trailing edge of the preceding paper Pa is detected by the registration sensor 21, when the movement amount E of the first opening 80*a* from the detection position of the belt sensor 25 due to traveling of the first conveyor belt 8 is (C−B) or more, at the time when the first opening 80A is facing the recording heads 17*a* to 17*c*, the controller 110 stops the execution of flushing by the recording heads 17*a* to 17*c*. Then, the controller 110 causes the pair of registration rollers 13 to supply the subsequent paper Pb onto the first conveyor belt 8 so that the subsequent paper Pb is placed on the upstream side of the second opening 80*b* detected by the belt sensor 25, and at the time when facing the second opening 80*b* due to the traveling of the first conveyor belt 8, the controller 110 causes the recording heads 17*a* to 17*c* to execute flushing.

Under the above conditions, when the preceding paper Pa merges the traveling first conveyor belt 8, the preceding paper Pa is placed by coinciding with the first opening 80*a*. Therefore, by using the first opening 80*a* to stop the flushing of the recording heads 17*a* to 17*c*, it is possible to avoid deterioration of the image quality of the recorded image of the preceding paper Pa. Further, since flushing is executed using the second opening 80*b* before the image formation on the subsequent paper Pb, image formation on the subsequent paper Pb can be performed satisfactorily.

4-2. When A<C<B

Figure 22:
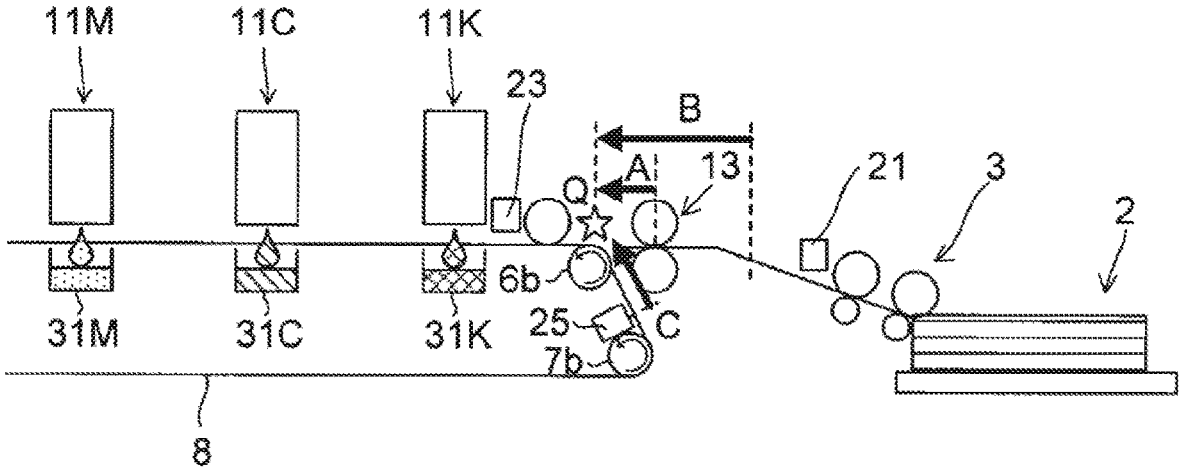
FIG. 22 is an explanatory diagram schematically illustrating another example of the positional relationships among a pair of registration rollers, a registration sensor, and a belt sensor in the printer.

FIG. 22 schematically illustrates another example of the positional relationship between the pair of registration rollers 13, the registration sensor 21, and the belt sensor 25. As shown in the figure, when the pair of registration rollers 13, the registration sensor 21 and the belt sensor 25 are arranged so as to have an A<C<B relationship, the flushing control and the paper P supply control are classified into three cases as follows.

Figure 23:
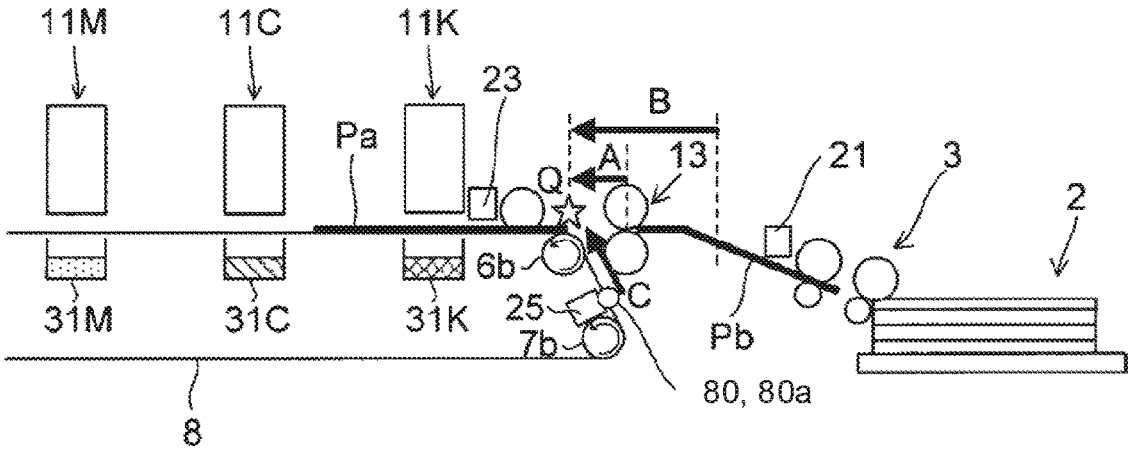
FIG. 23 is an explanatory diagram schematically illustrating an example of the positional relationship among the pair of registration rollers, the registration sensor, a preceding paper and a subsequent paper, and an opening of a first conveyor belt in the configuration of FIG. 22.

4-2-1. Detection of the Trailing Edge of the Leading Paper, Reaching of the Leading Edge of the Trailing Paper to the Pair of Registration Rollers FIG. 23 schematically illustrates a state in which the registration sensor 21 has already detected the trailing edge of the preceding paper Pa and at the point in time when the belt sensor 25 has detected the first opening 80*a* for flushing, the leading edge of the subsequent paper Pb reaches the pair of registration rollers 13. It is assumed that the pair of registration rollers 13 is stopped. In this case, after the first opening 80*a* has moved the distance (C−A) due to the traveling of the first conveyor belt 8, the controller 110 and causes the pair of registration rollers 13 to supply the subsequent paper Pb onto the first conveyor belt 8 (starting the second paper supply), and causes the recording heads 17*a* to 17*c* to execute flushing at the time when facing the first opening 80*a* due to the traveling of the first conveyor belt 8.

When the subsequent paper Pb is supplied to the first conveyor belt 8 at the above time, the traveling of the first conveyor belt 8 can cause the first opening 80*a* for flushing of the first conveyor belt 8, to be positioned between the preceding paper Pa and the subsequent paper Pb. Therefore, by using the first opening 80*a* to perform flushing, since the ink ejected at the time of flushing does not adhere to the preceding paper Pa, it is possible to avoid deterioration of the image quality of the recorded image of the preceding paper Pa. Further, by performing flushing using the first opening 80*a* before forming an image on the subsequent paper Pb, image formation on the subsequent paper Pb can be performed satisfactorily.

Figure 24:
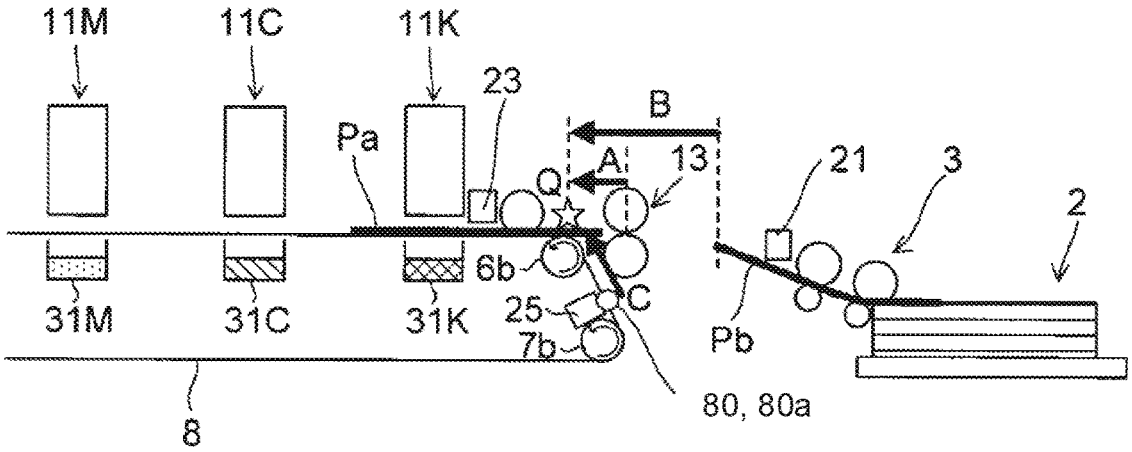
FIG. 24 is an explanatory diagram schematically illustrating another example of the above positional relationship.

4-2-2. Detection of the Trailing Edge of the Leading Paper when the Leading Edge of the Subsequent Paper has not Reached the Pair of Registration Rollers FIG. 24 schematically illustrates a state in which, the registration sensor 21 has already detected the trailing edge of the preceding paper Pa and at the point in time when the belt sensor 25 has detected the first opening 80*a* for flushing, the leading edge of the subsequent paper Pb has not reached the pair of registration rollers 13. The flushing control in this case and the supply control of the subsequent paper Pb to the first conveyor belt 8 are further classified into the following two cases.

4-2-2a. When the Movement Amount D of the Opening is (C−A) or Less when the Leading Edge of the Subsequent Paper has Reached the Pair of Registration Rollers FIG. 25 schematically illustrates a state in which, when the leading edge of the subsequent Paper Pb has reached the registration rollers 13, the movement amount D of the first opening 80*a* for flushing, due to the traveling of the first conveyor belt 8, detected by the belt sensor 25 is (C−A) or less.

Figure 25:
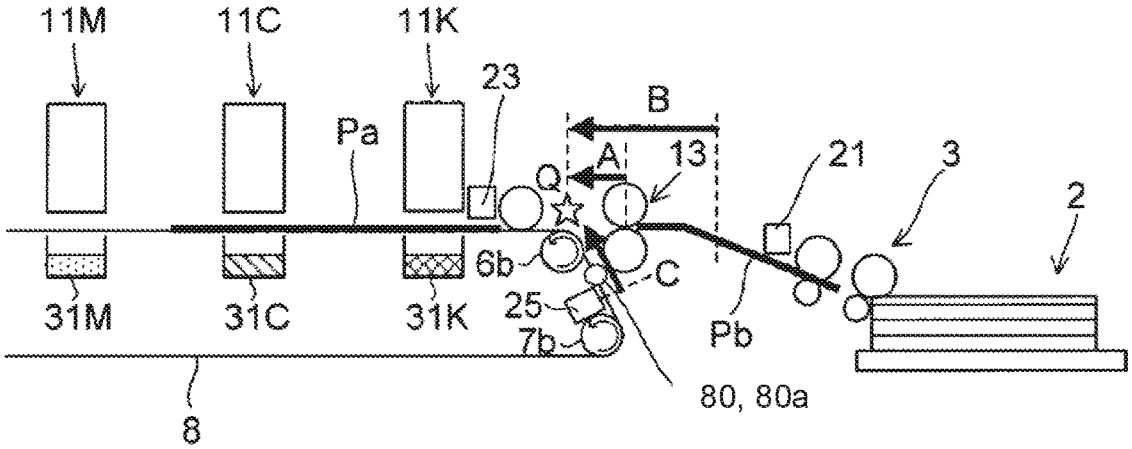
FIG. 25 is an explanatory diagram schematically illustrating yet another example of the above positional relationship.

When the trailing edge of the preceding paper Pa has already been detected by the registration sensor 21, and based on the detection of the leading edge of the subsequent paper Pb by the registration sensor 21, when it is determined that the leading edge of the subsequent paper Pb has not reached the pair of registration rollers 13, as shown in FIG. 25, at a later point in time when the leading edge of the subsequent paper Pb reaches the pair of registration rollers 13, when the movement amount D of the first opening 80*a*, from the detection position of the belt sensor 25 due to the traveling of the first conveyor belt 8, is (C−A) or less, the controller 110 performs the following control. That is, until the movement amount D of the first opening 80*a* exceeds (C−A) due to the traveling of the first conveyor belt 8, the controller 110 stops the supply of the subsequent paper Pb by the pair of registration rollers 13, and when the movement amount D exceeds (C−A), the controller 110 causes the pair of registration rollers 13 to supply the subsequent paper Pb onto the first conveyor belt 8, and at the time when the first opening 80*a* faces the recording heads 17*a* to 17*c*, the controller 110 causes the recording heads 17*a* to 17*c* to execute flushing.

In such a supply control of the subsequent paper Pb, after the first opening 80*a* for flushing has passed the merging position Q due to the traveling of the first conveyor belt 8, the subsequent paper Pb can be merged and placed onto the first conveyor belt 8. As a result, by performing flushing using the first opening 80*a* before forming an image on the subsequent paper Pb, image formation on the subsequent paper Pb can be performed satisfactorily.

4-2-2b. When the Movement Amount D of the Opening Exceeds (CA) when the Leading Edge of the Subsequent Paper Reaches the Pair of Registration Rollers FIG. 26, schematically illustrates a state in which, when the leading edge of the subsequent paper Pb reaches the pair of registration rollers 13, the movement amount D of the first opening 80*a* for flushing detected by the belt sensor 25, due to the traveling of the first conveyor belt 8, exceeds (C−A).

Figure 26:
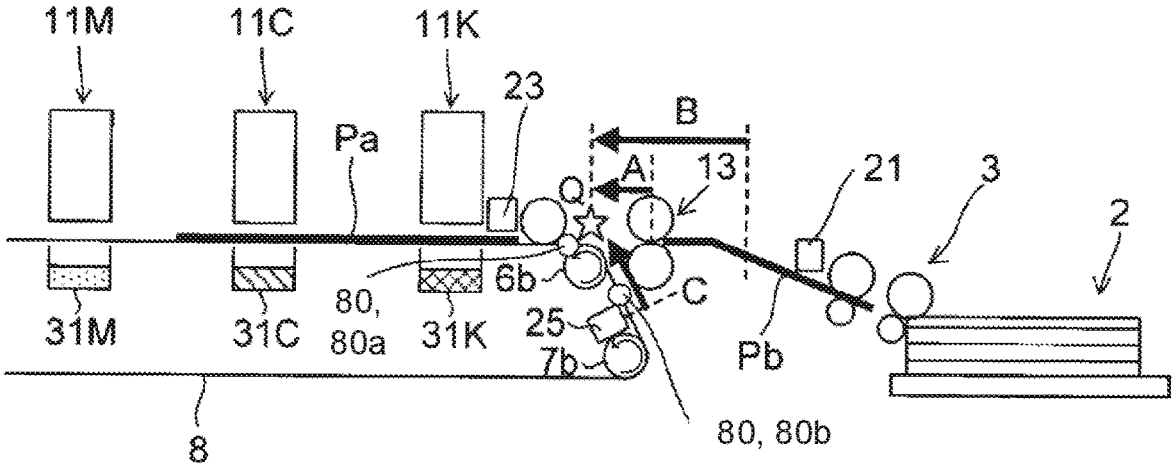
FIG. 26 is an explanatory diagram schematically illustrating yet another example of the above positional relationship.

When the trailing edge of the preceding paper Pa has already been detected by the registration sensor 21, and based on the detection of the leading edge of the subsequent paper Pb by the registration sensor 21, when it is determined that the leading edge of the subsequent paper Pb has not reached the pair of registration rollers 13, as shown in FIG. 26, at a later point in time when the leading edge of the subsequent paper Pb reaches the pair of registration rollers 13, when the movement amount D of the first opening 80*a*, from the detection position of the belt sensor 25 due to the traveling of the first conveyor belt 8, exceeds (C−A), the controller 110 performs the following control. That is, after the second opening 80*b* of the other opening group 82 is detected by the belt sensor 25, until the second opening 80*b* moves the distance (C−A) due to the traveling of the first conveyor belt 8, the controller stops the supply of the subsequent paper Pb by the pair of registration rollers 13, and after the movement amount exceeds (C−A), the controller 110 causes the pair of registration rollers 13 to supply the subsequent paper Pb to the first conveyor belt 8, and at the time when the second opening 80*b* faces the recording heads 17*a* to 17*c*, causes the recording heads 17*a* to 17*c* to execute flushing.

When the first opening 80*a*, first detected by the belt sensor 25, is positioned near the merging position Q due to the traveling of the first conveyor belt 8, if the supply of the subsequent paper Pb by the pair of registration rollers 13 to the first conveyor belt 8 is started (second paper supply), the interval between the first opening 80*a* and the subsequent paper Pb in the first conveyor belt 8 is too wide, so even if the first opening 80*a* is used to perform flushing, the ink in the ink ejection port 18 may dry in the time period until the next image formation on the subsequent paper Pb, and the effect of flushing will be reduced.

When the movement amount D of the first opening 80*a* exceeds (C−A), after the second opening 80*b* is detected by the belt sensor 25 and then after moving the distance of (C−A) due to the traveling of the first conveyor belt 8, the subsequent paper Pb is supplied onto the first conveyor belt 8 by the pair of registration rollers 13, so that the subsequent paper Pb can be placed immediately after the second opening 80*b* in the first conveyor belt 8. As a result, by performing flushing using the second opening 80*b* immediately before forming an image on the subsequent paper Pb, image formation on the subsequent paper Pb can be performed satisfactorily. Further, in the first conveyor belt 8, by narrowing the distance between the second opening 80*b* and the subsequent paper Pb, the interval between the opening 80 and the paper P can be made constant for any paper 80 and it becomes easier to keep the time of flushing using the opening P and the time of image formation on the paper P constant. As a result, ink ejection control for the recording heads 17*a* to 17*c* becomes easier.

4-2-3. Trailing Edge of Preceding Paper not Detected

Figure 27:
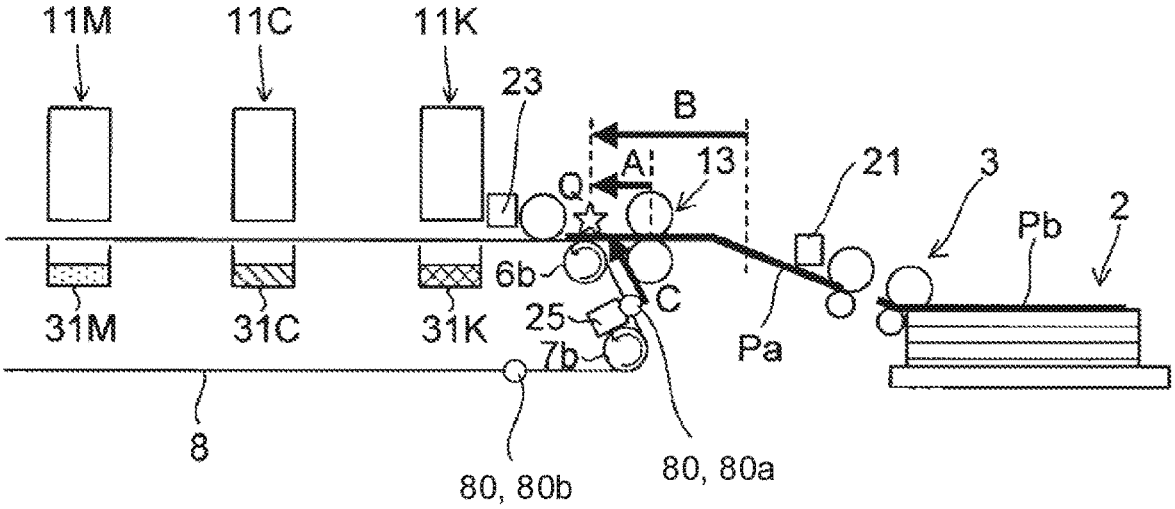
FIG. 27 is an explanatory diagram schematically illustrating yet another example of the above positional relationship.

FIG. 27 schematically illustrates a state in which the registration sensor 21 does not detect the trailing edge of the preceding paper Pa when the belt sensor 25 detects the first opening 80*a*. In this case, the controller 110 stops the execution of flushing by the recording heads 17*a* to 17*c* at the time when the first opening 80*a* faces the recording heads 17*a* to 17*c*, causes the pair of registration rollers 13 to supply the subsequent paper Pb onto the first conveyor belt 8 so that the subsequent paper Pb is placed to the upstream side of the second opening 80*b* (for example, after the belt sensor 25 detects the second opening 80*b* and after the second opening 80*b* travels the distance (C−A)), and causes the recording heads 17*a* to 17*c* to execute flushing at the time of facing the second opening 80*b* due to the traveling of the first conveyor belt 8.

If the registration sensor 21 does not detect the trailing edge of the preceding paper Pa at the point in time when the belt sensor 25 detects the first opening 80*a*, the preceding paper Pa is placed on the first conveyor belt 8 to coincide with the first opening 80*a* (the first opening 80*a* does not completely pass through the merging position Q). Therefore, by stopping the flushing of the recording heads 17*a* to 17*c* using the first opening 80*a*, it is possible to avoid deterioration of the image quality of the recorded image of the preceding paper Pa. Further, since flushing is executed using the second opening 80*b* before the image formation on the subsequent paper Pb, image formation on the subsequent paper Pb can be performed satisfactorily.

5. Others

In the present embodiment, the first conveyor belt 8 has opening groups 82 irregularly positioned in the conveyance direction. When such a first conveyor belt 8 is used, the paper P is placed on the opening group 82 positioned in a pattern corresponding to the size of the paper P so as to be offset in the conveyance direction, to form an image on the paper P, and flushing can be performed using the opening group 82. However, when the preceding paper Pa coincides with the opening group 82 (opening 80) positioned in the above pattern due to a conveyance delay from slipping or the like, it becomes difficult to expose the other opening 80 used for flushing between the preceding paper Pa and the subsequent paper Pb, and it becomes difficult to secure a flushing opportunity before forming an image on the subsequent paper Pb. Therefore, the control of the present embodiment, in which the flushing opportunity can be secured before the image formation on the subsequent paper Pb, is particularly effective when using the first conveyor belt 8 having the opening groups 82 irregularly positioned in the conveyance direction.

The first conveyor belt 8 is not limited to the configuration in which the opening groups 82 are irregularly positioned in the conveyance direction as described above. For example, the first conveyor belt 8 may have a configuration in which the opening groups 82 are positioned at equal intervals in the conveyance direction.

In the above, the case where the paper P is attracted to the first conveyor belt 8 by negative pressure suction and conveyed has been described. However, the first conveyor belt 8 may be charged and the paper P may be electrostatically attached to the first conveyor belt 8 and conveyed (electrostatic attachment method).

In the above, an example of using a color printer that records a color image using four color inks as an inkjet recording apparatus has been described, but even when a monochrome printer that records a monochrome image using black ink is used, it is possible to apply control of supply of the paper P as described in the present embodiment.

The present disclosure can be applied to an inkjet recording apparatus that ejects ink onto a recording medium to record an image.

What is claimed is:

1. An inkjet recording apparatus comprising:

a recording head having a plurality of nozzles that eject ink;

an endless conveyor belt that conveys a recording medium to a position facing the recording head, and has a plurality of openings in a conveyance direction of the recording medium through which the ink passes when the recording head executes flushing by ejecting ink at a time different from the time that contributes to image formation on the recording medium;

a pair of registration rollers that supply the recording medium onto the endless conveyor belt;

a first detection sensor that detects a recording medium, by being positioned on an upstream side of the pair of registration rollers in a supply direction of the recording medium;

a second detection sensor that detects a position of an opening of the conveyor belt; and a controller that controls the recording head and the pair of registration rollers, wherein the controller determines whether the recording medium supplied onto the conveyor belt by the pair of registration rollers is placed on the conveyor belt coinciding with an opening that is moved due to traveling of the conveyor belt based on a detection result of the trailing edge of the recording medium by the first detection sensor and a detection result of the opening by the second detection sensor, and controls the execution of flushing by the recording head and controls supply of a subsequent recording medium by the pair of registration rollers onto the conveyor belt, based on a result of the determination, wherein when the opening is set as a first opening, when the controller has determined that the preceding recording medium is placed on the conveyor belt without coinciding with the first opening, based on a position of the first opening at the point in time when the leading edge of the subsequent recording medium reaches the pair of registration rollers, the controller determines whether the subsequent recording medium is to be placed on an upstream side of the first opening or an upstream side of a second opening, which is another opening that is detected by the second detection sensor after detection of the first opening and is moved due to the traveling of the conveyor belt, and at a time based on the determination result, the controller causes the pair of registration rollers to supply the subsequent recording medium onto the conveyor belt, and, between the first opening and the second opening, causes the recording head to execute flushing at a time when facing an opening closest to the subsequent recording medium placed on the conveyor belt.

2. The inkjet recording apparatus according to claim 1, wherein the conveyor belt has a group of openings having a row of openings in which the openings are arranged in a belt width direction perpendicular to the conveyance direction of the recording medium in the conveyor belt at a plurality of locations in the conveyance direction, and wherein the opening groups are irregularly positioned in the conveyance direction in one cycle of the conveyor belt.

3. An inkjet recording apparatus according to claim 1, wherein, when the controller determines that a preceding recording medium whose trailing edge is detected by the first detection sensor is mounted on the conveyor belt while coinciding with the first opening moved due to traveling of the conveyor belt, the controller stops execution of the flushing by the recording head at the time when facing the first opening due to the traveling of the conveyor belt, and causes the subsequent recording medium to be supplied onto the conveyor belt by the pair of registration rollers so that the subsequent recording medium is placed on the upstream side of the second opening, and the controller causes the recording head to execute flushing at the time when facing the second opening due to the traveling of the conveyor belt.

4. An inkjet recording apparatus comprising:

a recording head having a plurality of nozzles that eject ink;

an endless conveyor belt that conveys a recording medium to a position facing the recording head, and has a plurality of openings in a conveyance direction of the recording medium through which the ink passes when the recording head executes flushing by ejecting ink at a time different from the time that contributes to image formation on the recording medium;

a pair of registration rollers that supply the recording medium onto the endless conveyor belt;

a first detection sensor that detects a recording medium, by being positioned on an upstream side of the pair of registration rollers in a supply direction of the recording medium;

a second detection sensor that detects a position of an opening of the conveyor belt; and a controller that controls the recording head and the pair of registration rollers, wherein the controller determines whether the recording medium supplied onto the conveyor belt by the pair of registration rollers is placed on the conveyor belt coinciding with an opening that is moved due to traveling of the conveyor belt based on a detection result of the trailing edge of the recording medium by the first detection sensor and a detection result of the opening by the second detection sensor, and controls the execution of flushing by the recording head and controls supply of a subsequent recording medium by the pair of registration rollers onto the conveyor belt, based on a result of the determination, wherein when the opening is set as a first opening, when a point where the recording medium supplied toward the conveyor belt by the pair of registration rollers merges with the conveyor belt is a merging position, and a conveyance distance of the recording medium from the pair of registration rollers to the merging position is A (mm), a conveyance distance of the recording medium from a detection position of the first detection sensor to the merging position is B (mm), and a movement distance of the first opening or a second opening, which is another opening that is detected by the second detection sensor after detection of the first opening and is moved due to the traveling of the conveyor belt, based on the traveling of the conveyor belt from the detection position of the second detection sensor to the merging position, is C (mm), if $A<B<C$ or $A<C<B$, when the trailing edge of the preceding recording medium has already been detected by the first detection sensor and at the point in time when the first opening is detected by the second detection sensor, based on the detection of the leading edge of the subsequent recording medium by the first detection sensor, when the controller determines that the leading edge of the subsequent recording medium has reached the pair of registration rollers, after the first opening has moved the distance $(C-A)$ due to the traveling of the conveyor belt, the controller causes the subsequent recording medium to be supplied onto the conveyor belt by the pair of registration rollers, and at a time when facing the first opening due to the traveling of the conveyor belt, the controller causes the recording head to execute flushing.

5. The inkjet recording apparatus according to claim 4, wherein when the trailing edge of the preceding recording medium has already been detected by the first detection sensor and when it is determined based on detection of the leading edge of the subsequent recording medium by the first detection sensor, that the leading edge of the subsequent recording medium has not reached the pair of registration rollers, at a later point in time when the leading edge of the subsequent recording medium reaches the pair of registration rollers, the movement amount of the first opening due to the traveling of the belt from a detection position of the second detection sensor is (C−A) or less, after the amount of movement exceeds (C−A), the controller causes the pair of registration rollers to supply the subsequent recording medium to the conveyor belt, and, at a time when the first opening faces the recording head, the controller causes the recording head to execute flushing.

6. The inkjet recording apparatus according to claim 4, wherein when the trailing edge of the preceding recording medium has already been detected by the first detection sensor and when it is determined based on detection of the leading edge of the subsequent recording medium by the first detection sensor, that the leading edge of the subsequent recording medium has not reached the pair of registration rollers, when, at a later point in time when the leading edge of the subsequent recording medium reaches the pair of registration rollers, the movement amount of the first opening, due to the traveling of the conveyor belt, from the detection position according to the second detection sensor, exceeds (C−A), the controller stops the supply of the subsequent recording medium by the pair of registration rollers after the second opening is detected by the second detection sensor and until the second opening moves the distance (C−A) due to the travelling of the conveyor belt, and after the second opening moves the distance (C−A), the controller causes the pair of registration rollers to supply the subsequent recording medium onto the conveyor belt and, at a time when the second opening faces the recording head, causes the recording head to execute flushing.

7. The inkjet recording apparatus according to claim 4, wherein when A<B<C, when the controller determines that the trailing edge of the preceding recording medium has not been detected by the first detection sensor, at a later point in time when the first detection sensor detects the trailing edge of the preceding recording medium, when the movement amount of the first opening due to the traveling of the belt from the detection position of the second detection sensor is less than (C−B), the controller causes the pair of registration rollers to supply the subsequent recording medium onto the conveyor belt so that the subsequent recording medium is placed on the upstream side of the first opening, and, at a time when the first opening faces the recording head, causes the recording head to execute flushing.

8. The inkjet recording apparatus according to claim 4, wherein when A<B<C, when the controller determines that the trailing edge of the preceding recording medium has not been detected by the first detection sensor, at a later point in time when the first detection sensor detects the trailing edge of the preceding recording medium, when the movement amount of the first opening due to the traveling of the belt from the detection position by the second detection sensor is (C−B) or more, the controller stops the execution of flushing by the recording head at the time when the first opening faces the recording head, and the controller causes the pair of registration rollers to supply the subsequent recording medium onto the conveyor belt so the subsequent recording medium is placed on the upstream side of the second opening, and at a time when facing the second opening due to the traveling of the conveyor belt, the controller causes the recording head to execute flushing.

9. The inkjet recording apparatus according to claim 4, wherein when A<C<B, at the point in time when the first opening is detected by the second detection sensor, when the controller determines that the trailing edge of the preceding recording medium has not been detected by the first detection sensor, the controller stops the execution of flushing by the recording head at the time when the first opening faces the recording head, and causes the subsequent recording medium to be supplied onto the conveyor belt by the pair of registration rollers so the subsequent recording medium is placed on the upstream side of the second opening, and, at a time when facing the second opening due to the traveling of the conveyor belt, the controller causes the recording head to execute flushing.

10. An inkjet recording apparatus according to claim 4, wherein, when the controller determines that a preceding recording medium whose trailing edge is detected by the first detection sensor is mounted on the conveyor belt while coinciding with the first opening moved due to traveling of the conveyor belt, the controller stops execution of the flushing by the recording head at the time when facing the first opening due to the traveling of the conveyor belt, and causes the subsequent recording medium to be supplied onto the conveyor belt by the pair of registration rollers so that the subsequent recording medium is placed on the upstream side of the second opening, and the controller causes the recording head to execute flushing at the time when facing the second opening due to the traveling of the conveyor belt.

11. The inkjet recording apparatus according to claim 4, wherein the conveyor belt has a group of openings having a row of openings in which the openings are arranged in a belt width direction perpendicular to the conveyance direction of the recording medium in the conveyor belt at a plurality of locations in the conveyance direction, and wherein the opening groups are irregularly positioned in the conveyance direction in one cycle of the conveyor belt.

* * * * *